US011466848B1

(12) United States Patent
Portinga et al.

(10) Patent No.: US 11,466,848 B1
(45) Date of Patent: Oct. 11, 2022

(54) LIGHT ENGINE MODULE MATES WITH HEAT SINK

(71) Applicant: Troy-CSL Lighting Inc., City of Industry, CA (US)

(72) Inventors: Joshua Portinga, Chino Hills, CA (US); Calvin Wong, Diamond Bar, CA (US)

(73) Assignee: Troy-CSL Lighting Inc., City of Industry, CA (US)

( * ) Notice: Subject to any disclaimer, the term of this patent is extended or adjusted under 35 U.S.C. 154(b) by 0 days.

(21) Appl. No.: 17/395,334

(22) Filed: Aug. 5, 2021

(51) Int. Cl.

| | |
|---|---|
| ***F21V 29/71*** | (2015.01) |
| ***F21S 8/02*** | (2006.01) |
| ***F21V 21/04*** | (2006.01) |

(52) U.S. Cl.
CPC ..... *F21V 29/713* (2015.01); *F21S 8/02* (2013.01); *F21V 21/04* (2013.01)

(58) Field of Classification Search
CPC ..... F21S 8/02–028; F21V 21/04–049; F21V 29/70; F21V 29/713; F21V 29/73
See application file for complete search history.

(56) References Cited

U.S. PATENT DOCUMENTS

| | | | |
|---|---|---|---|
| 10,900,654 B1 | 1/2021 | Nguyen et al. | |
| 11,226,087 B2 * | 1/2022 | Wickham | F21V 29/773 |

* cited by examiner

*Primary Examiner* — Sean P Gramling
(74) *Attorney, Agent, or Firm* — Foley & Lardner LLP

(57) ABSTRACT

A lighting device system includes at least one lighting device module having a module housing configured to be inserted at least partially through an opening in a panel, and at least one heat sink member having a contact surface. The at least one heat sink member is located adjacent the opening in the panel. The module housing is held in contact with the contact surface of the at least one heat sink member when the module housing is inserted at least partially through the opening in the panel in an installed state. The module housing is configured to be selectively withdrawn from the contact surface of the heat sink member, through the opening in the panel.

18 Claims, 7 Drawing Sheets

LIGHT ENGINE MODULE MATES WITH HEAT SINK

BACKGROUND

Modern lighting devices have electronic light sources for emitting light, such as one or more light emitting diode (LED) components. Typically, the brightness of an LED light source is at least partially related to the speed in which heat can be transferred away from the LED component. For example, it may be desirable to maintain the temperature of the LED under about 105° Celsius for improved or maximum light output and efficiency. However, certain lighting devices such as, but not limited to, room or area lighting devices, may be configured to be mounted in an enclosed environment, such as in a housing and/or in a recess of a ceiling, wall or other structure. In those or other contexts, the lighting device may be mounted in a thermally contained or poorly ventilated environment that can inhibit the ability to quickly transfer heat away from the LED. Accordingly, it can be desirable to provide lighting device configurations that allow for sufficient transfer of heat from the LED light source to maintain the temperature of the light source at or below a threshold temperature during operation and, particularly, during operation in a thermally contained or poorly ventilated environment.

Lighting device assemblies of various examples described herein can be configured to have good heat transfer characteristics (to transfer and dissipate heat away from the LED), while also allowing the lighting device assembly to be located within a housing and/or within a recess or opening in a ceiling, wall or other object. In other examples, the lighting device assembly may be surface mounted on a surface of a ceiling, wall or other object, or mounted on a pedestal or other support structure extending from a ceiling, wall, or other object. In yet other examples, the lighting device assembly may be mounted in other suitable locations or environments.

SUMMARY

An example of a lighting device system includes at least one lighting device module having a module housing configured to be inserted at least partially through an opening in a panel, and at least one heat sink member having a contact surface, the at least one heat sink member being located adjacent the opening in the panel. The module housing is held in contact with the contact surface of the at least one heat sink member when the module housing is inserted at least partially through the opening in the panel in an installed state, and is configured to be selectively withdrawn from the contact surface of the heat sink member, through the opening in the panel.

Further examples of the lighting device system further include at least one biasing device mounted adjacent the opening in the panel to apply a bias force on the at least one module housing, the bias force pressing the at least one module housing against the contact surface of the at least one heat sink member when the at least one module housing is inserted at least partially through the opening in the installed state.

Further examples of the lighting device system further include a base plate made of a thermally conductive material and having an opening configured to be aligned with an opening in a panel at an installation site. Each heat sink member is mounted on the base plate, adjacent the opening in the base plate. Each module housing is configured to be inserted at least partially through the openings in the base plate and in the panel, and placed in contact with the contact surface of at least one of the heat sink members, when the opening in the base plate is aligned with the opening in the panel.

Further examples of the lighting device system further include at least one biasing device mounted on the base plate adjacent the opening in the base plate, to apply a bias force on the module housing of each lighting device module, to press the module housing against the contact surface of one or more of the at least one heat sink member when the module housing is inserted at least partially through the opening in the base plate.

In further examples of the lighting device system, each biasing device includes a spring-biased plunger or ball that is arranged to press against an outer surface of the module housing and force the module housing in a direction toward the contact surface of one or more of the at least one heat sink member.

Further examples of the lighting device system further include driver electronics mounted on the base plate and electrically connected to a light source of each lighting device module.

In further examples of the lighting device system, the light source comprises at least one LED device and wherein the driver electronics comprises at least one LED driver.

Further examples of the lighting device system further include a cover member configured to cover the base plate and to be mounted in a fixed relation relative to the opening in the panel, and a rotary mount for supporting the base plate for rotation relative to the cover member, to allow the rotational orientation of the base plate relative to the opening in the panel to be adjusted.

In further examples of the lighting device system, the at least one lighting device module comprises a plurality of lighting device modules.

In further examples of the lighting device system, the at least one heat sink member comprises a plurality of heat sink members, and the module housing of each lighting device module is held in contact with the contact surface of a respective one of the plurality of heat sink members when each module housing is inserted at least partially through the opening in the panel in an installed state, and is configured to be selectively withdrawn from the contact surface of the heat sink member, through the opening in the panel.

Further examples of the lighting device system further include a trim panel connected to a light output side of each lighting device module of the plurality of lighting device modules.

Further examples of the lighting device system further include at least one lens mounted on the trim panel, at a location through which light from the plurality of lighting device modules passes.

Further examples relate to a lighting device system including at least one lighting device module, each having a module housing configured to be inserted at least partially through an opening in a panel. The lighting device system further includes at least one heat sink member, each having a contact surface and each being located adjacent the opening in the panel, and at least one biasing device located adjacent the opening in the panel, to apply a bias force on the module housing of each of the lighting device modules, to press each of the module housing against the contact surface of one or more of the heat sink members when the module housing is inserted at least partially through the opening in the panel. The module housing of each of the lighting device modules is pressed against and held in contact with the contact surfaces of one or more of the heat sink members when each of the module housings is inserted at least partially through the opening in the panel in an installed state, and is configured to be selectively withdrawn from the contact surfaces of the one or more heat sink members, through the opening in the panel.

In further examples of the lighting device system, the at least one lighting device module comprises a plurality of lighting device modules, the at least one heat sink member comprises a plurality of heat sink members, and the at least one biasing device comprises a plurality of biasing devices.

Further examples of the lighting device system further include a base plate made of a thermally conductive material and having an opening configured to be aligned with an opening in a panel at an installation site. Each heat sink member is mounted on the base plate, adjacent the opening in the base plate. Each module housing is configured to be inserted at least partially through the openings in the base plate and in the panel, and placed in contact with the contact surface of at least one of the heat sink members, when the opening in the base plate is aligned with the opening in the panel.

Further examples of that lighting device system further include a cover member configured to cover the base plate and to be mounted in a fixed relation relative to the opening in the panel, and a rotary mount for supporting the base plate for rotation relative to the cover member, to allow the rotational orientation of the base plate relative to the opening in the panel to be adjusted to align the opening in the base plate with the opening in the panel.

Further example relate to a method of making a lighting device system, including providing one or more lighting device modules, each having a module housing configured to be inserted at least partially through an opening in a panel. The method further includes mounting at least one heat sink members adjacent the opening in the panel, each heat sink member having a contact surface. The method further includes mounting at least one biasing device adjacent the opening in the panel, to apply a bias force on the module housing of each lighting device module, to press each of the module housing against the contact surface of the at least one heat sink member when the module housing is inserted at least partially through the opening in the panel. The module housing of each lighting device module is pressed against and held in contact with the contact surface of the at least one heat sink member when the module housing are inserted at least partially through the opening in the panel in an installed state, and is configured to be selectively withdrawn from the contact surface of the at least one heat sink member, through the opening in the panel.

In further examples of the method, the at least one lighting device module comprises a plurality of lighting device modules, the at least one heat sink member comprises a plurality of heat sink members, and the at least one biasing device comprises a plurality of biasing devices.

In further examples, the method further includes arranging a base plate on the panel, the base plate being made of a thermally conductive material and having an opening configured to be aligned with the opening in the panel at an installation site, and inserting each module housing at least partially through the openings in the base plate and in the panel, and placing each module housing in contact with the contact surface of at least one of the heat sink members, when the opening in the base plate is aligned with the opening in the panel.

In further examples, the method further includes covering the base plate with a cover member mounted in a fixed relation relative to the opening in the panel, and supporting the base plate for rotation relative to the cover member, to allow the rotational orientation of the base plate relative to the opening in the panel to be adjusted to align the opening in the base plate with the opening in the panel.

BRIEF DESCRIPTION OF THE DRAWINGS

The above and other aspects and features of the present invention will become more apparent to those skilled in the art from the following detailed description of the example embodiments with reference to the accompanying drawings, in which.

DETAILED DESCRIPTION

Figure 1:
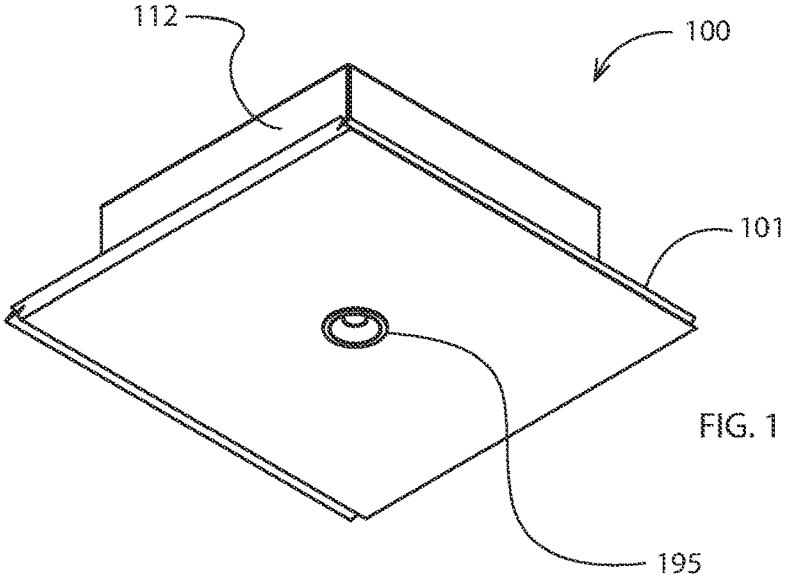
FIG. 1 is a perspective view of an example of a lighting device system

Hereinafter, example embodiments will be described in more detail with reference to the accompanying drawings. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof may not be repeated. Further, features or aspects within each example embodiment should typically be considered as available for other similar features or aspects in other example embodiments.

In the drawings, the relative sizes of elements, layers, and regions may be exaggerated and/or simplified for clarity.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

It will be understood that when an element or layer is referred to as being "on," "connected to," "coupled to," "secured to" or "attached to" another element or feature, it can be directly on, connected to, coupled to, secured to or attached to the other element or layer, or one or more intervening elements or layers may be present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments and is not intended to be limiting of the present invention. As used herein, the singular forms "a" and "an" are intended to include the plural forms as well, unless the context clearly indicates otherwise. It will be further understood that the terms "comprises," "comprising," "includes," and "including," "has," "have," and "having," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent variations in measured or calculated values that would be recognized by those of ordinary skill in the art. Further, the use of "may" when describing embodiments of the present invention refers to "one or more embodiments of the present invention." As used herein, the terms "use," "using," and "used" may be considered synonymous with the terms "utilize," "utilizing," and "utilized," respectively. Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

According to various examples described herein, a lighting device system is configured as a recessed lighting device for mounting in a ceiling, wall or other structure, by recessing the lighting device within or behind a ceiling panel, wall panel or other structure. For example, the lighting device system may be configured to be installed in an opening to a plenum, duct or attic space of a ceiling, or in an inner wall space in a manner to appear flush or substantially flush with an exposed surface of a ceiling, wall or other object. In other examples, variations of the lighting device system may be configured to be installed in a manner that is not flush with an exposed surface (and, instead, is configured to be recessed or protruding from the exposed surface of a ceiling, wall, outer housing or other object), or is configured to be surface-mounted on the exposed surface of the ceiling, wall, outer housing or other object. In yet other examples, variations of the lighting device system may be configured to be mounted on a support structure (such as, but not limited to a sconce structure, pedestal, shaft or the like).

The lighting device system includes a lighting device module having a light source and an optic member that are configured to emit light in a cone or other pattern. In examples in which the optic member includes one or more lenses, where the axis of the light emission may correspond to an optical axis of the one or more lenses. In other examples, the axis of the light emission may correspond to a center of the light cone or pattern emitted by the light source and optic member.

Particular examples are configured to provide sufficient thermal communication and heat dissipation characteristics to help maintain the temperature of the light source at or below a desired threshold temperature for improved operation. In addition to thermal communication, the lighting device system and module may be configured for ease of manufacture, assembly or servicing. In particular examples, the lighting device system and module may be configured to allow adjustment of a direction of light emission from the lighting module about multiple axis.

Lighting Device System 100

A perspective view of an example of a lighting device system 100, in an assembled state and attached to or installed on a panel 101 is shown in FIG. 1. In certain examples, the panel 101 is not part of the lighting device system 100, but represents a portion of a ceiling panel, a wall panel or a panel of another structure in which the lighting device system 100 is installed (or configured to be installed). In other examples, the panel 101 may be included as part of the lighting device system 100.

Figure 2:
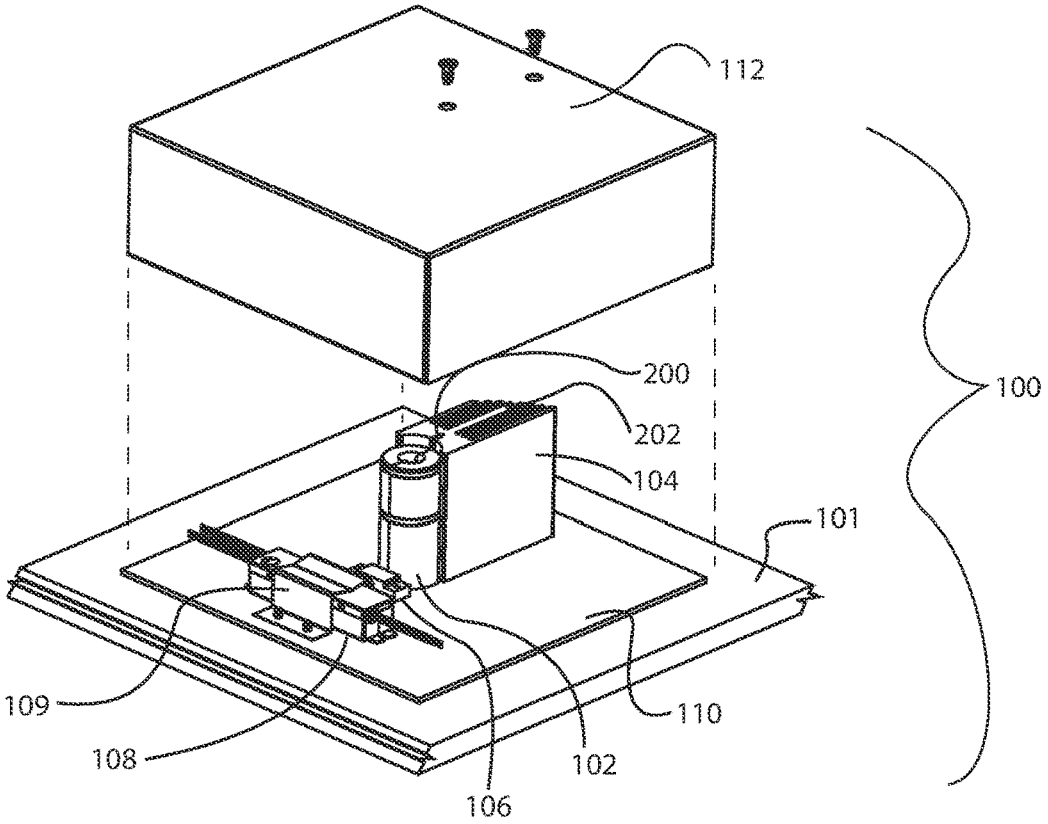
FIG. 2 is a partially exploded, perspective view of the lighting device system of FIG. 1, with the cover separated from the rest of the system.
Figure 3:
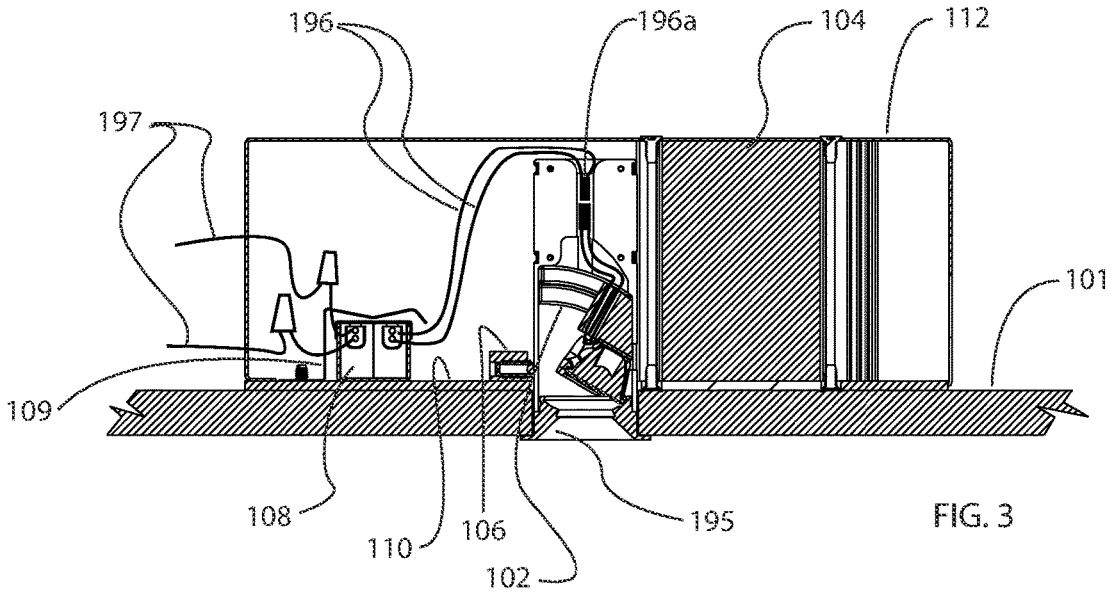
FIG. 3 is a cross-section view of the lighting device system of FIG. 1.
Figure 4:
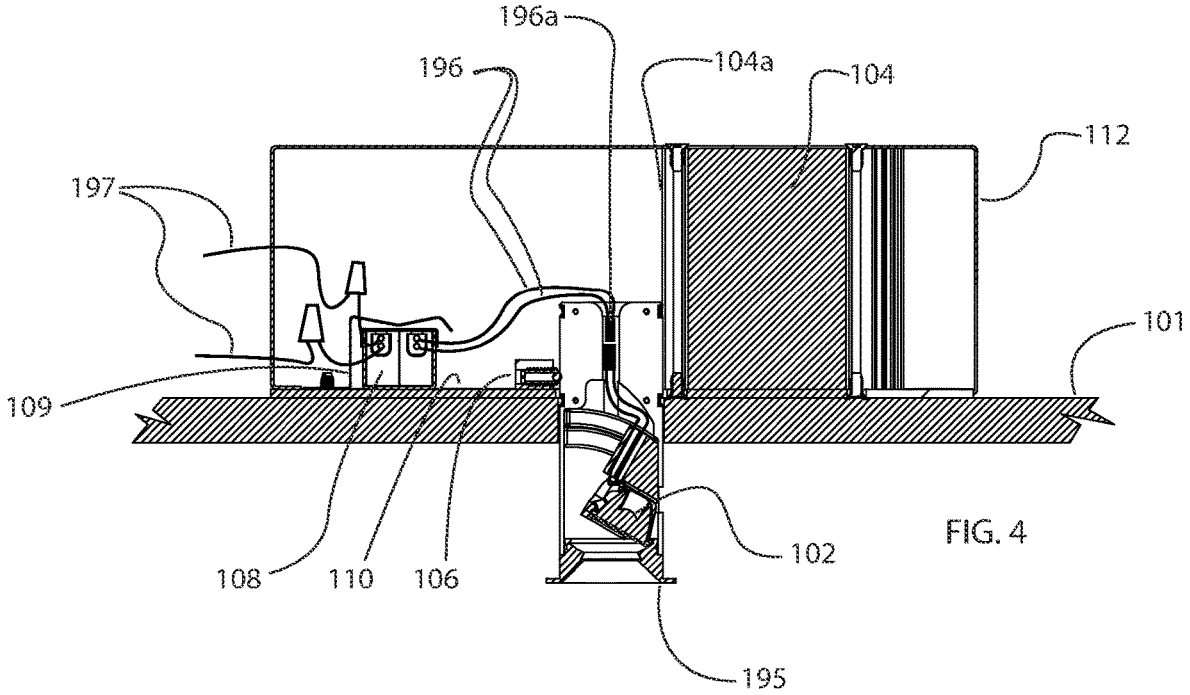
FIG. 4 is another cross-section view of the lighting device system of FIG. 1, with the lighting device module in a partially inserted state.

FIG. 2 is a partially exploded, perspective view of the same lighting device system 100 on the panel 101, but with a cover member separated along an axis A from the rest of the system 100, to show additional components of the system 100. Cross-section, side views of the lighting device system 100 are shown in FIGS. 3 and 4. A lighting device module 102 of the lighting device system 100 is shown in cross-section, side views in FIGS. 5 and 6, and in an exploded view in FIG. 7.

In the example of FIGS. 1-7, the lighting device system 100 includes a lighting device module 102, a heat sink 104, a biasing device 106 that biases the lighting device module 102 toward the heat sink 104 and driver electronics 108. In certain examples, as shown in FIGS. 1-4, the lighting device system 100 also includes a housing that may include a base plate 110 on which the heat sink 104, the biasing device 106 and the driver electronics 108 are attached or supported. The base plate 110 may be made of any suitable material and, in particular examples, is made of a material having good (relatively high or fast rate) thermal conduction characteristics, such as, but not limited to a heat dissipating metal, plastic, ceramic or composite material, for dissipation of heat from the heat sink member 104 mounted on the base plate 110. In other examples, the base plate 110 is omitted and the heat sink 104, the biasing device 106 and the driver electronics 108 are attached or supported directly on the panel 101.

In certain examples, the housing includes a cover member 112 that covers the lighting device module 102, the heat sink 104, the biasing device 106 and the driver electronics 108. The cover member 112 may be a box-like structure having an open side (the bottom side in FIGS. 1-4). In other examples, the cover member may have other suitable shapes. The cover member 112 may be made of any suitably rigid material and, in particular examples, the cover member 112 and the base plate 110 are made of an electrically conductive metal material (or other electrically conductive material) that can be electrically connected to ground (e.g., to a ground conductor present at the installation site), to provide a grounded barrier around the components of the lighting device system 100. The cover member 112 may be configured to connect (or is connected) to the base plate 110, or to the panel 101, as shown in FIGS. 1, 3 and 4. In other examples, the cover member 112 may be omitted. In yet other examples, one or more (or each) of the heat sink 104, the biasing device 106 and the driver electronics 108 may be attached to and supported on the cover member 112, instead of on the base plate 110 or the panel 101.

The lighting device system 100 may include additional components, including those described below. In other examples, the lighting device system 100 may include more than one lighting device module 102 and, in yet further examples, may include a corresponding more than one heat sink 104, biasing device 106 and/or driver electronics 108. While FIGS. 1-7 show one example of a lighting device system shape and relative dimensions, other embodiments have other suitable shapes and relative dimensions.

Lighting Device Module 102

The lighting device module 102 is configured to be selectively installed in and received by the rest of the lighting device system 100, as shown in FIGS. 1-4. In particular examples, the lighting device module 102 is configured to be selectively installed in and removed from the rest of the lighting device system 100 by sliding the lighting device module 102 through an opening in the panel 101, as shown by the double-arrow in FIG. 4.

In particular examples, the rest of the lighting device system 100 (as described below) is initially installed in a ceiling, wall or other structure, adjacent a hole or opening formed through the panel 101. Then, the lighting device module 102 may be slid at least partially through the opening and into the lighting device system 100 (in the upward direction of FIG. 4), to install and connect the lighting device module 102 to the rest of the lighting device system 100. In the installed state, the lighting device module 102 is configured to direct light through that same opening in the panel 101.

From the installed state, the lighting device module 102 may be selectively slid out or partially out of the lighting device system 100 (in the downward direction of FIG. 4). In particular examples, the lighting device module 102 is configured to be slid into or out of the lighting device system 100 (as shown in FIG. 4) by applying a manual pushing or pulling force on the lighting device module 102. In other examples, a tool may be used to apply those forces.

By configuring the lighting device module 102 to be selectively slid into or out of the lighting device system 100, through a single, relatively small opening in the panel 101, one or more benefits may be achieved. For example, such configurations can allow the lighting device system 100 to be concealed behind the panel 101 (e.g., within an inner ceiling space, an inner wall space, a plenum or duct space or an inner space of another object), while a relatively small opening is provided for light from the lighting device module 102 to pass. Alternatively or in addition, such configurations can allow the lighting device module 102 to be installed in the rest of the lighting device system 100, and to be selectively removed from the rest of the lighting device system 100, through the relatively small opening in the panel 101, for example, to replace, inspect, adjust or service the lighting device module 102. In particular examples, the lighting device module 102 is configured to provide one or more of those advantages, while also providing a good (relatively high or fast rate) of thermal communication for thermal transfer and dissipation of heat from the lighting device module 102 to the heat sink 104, when the lighting device module 102 is installed in the lighting device system 100.

Figure 5:
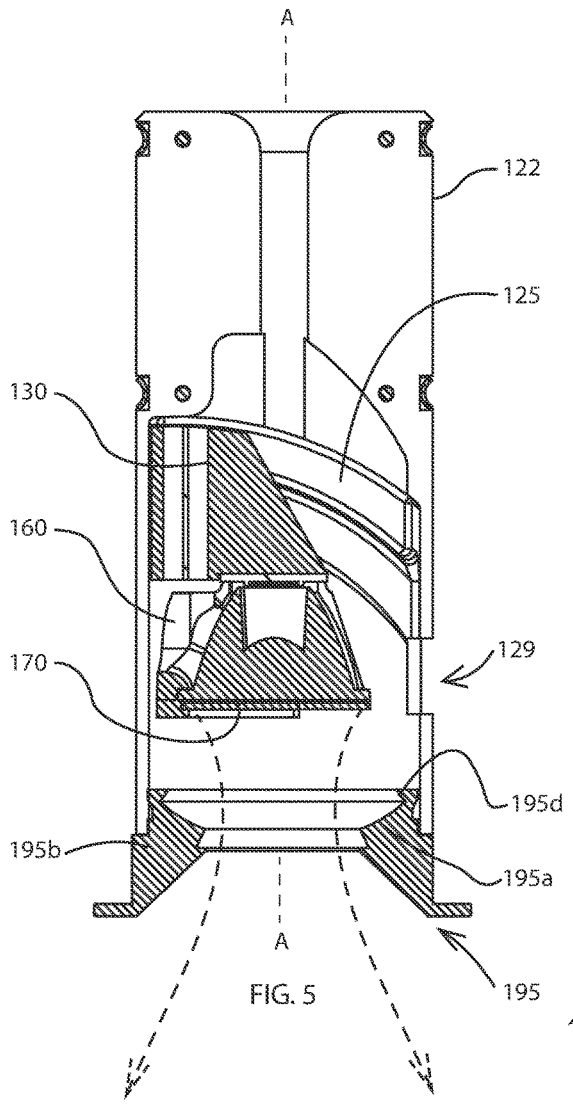
FIG. 5 is a cross-section view of a lighting device module of the lighting device system of FIG. 1.
Figure 6:
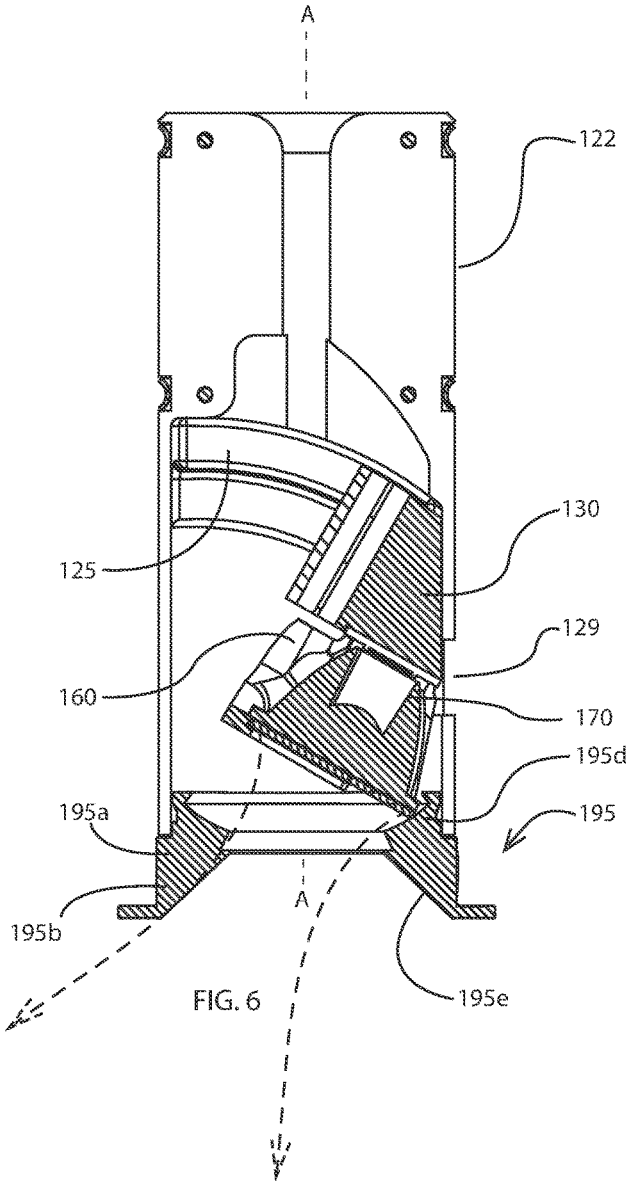
FIG. 6 is another cross-section view of a lighting device module of the lighting device system of FIG. 1, with the light source oriented different relative to FIG. 5.
Figure 7:
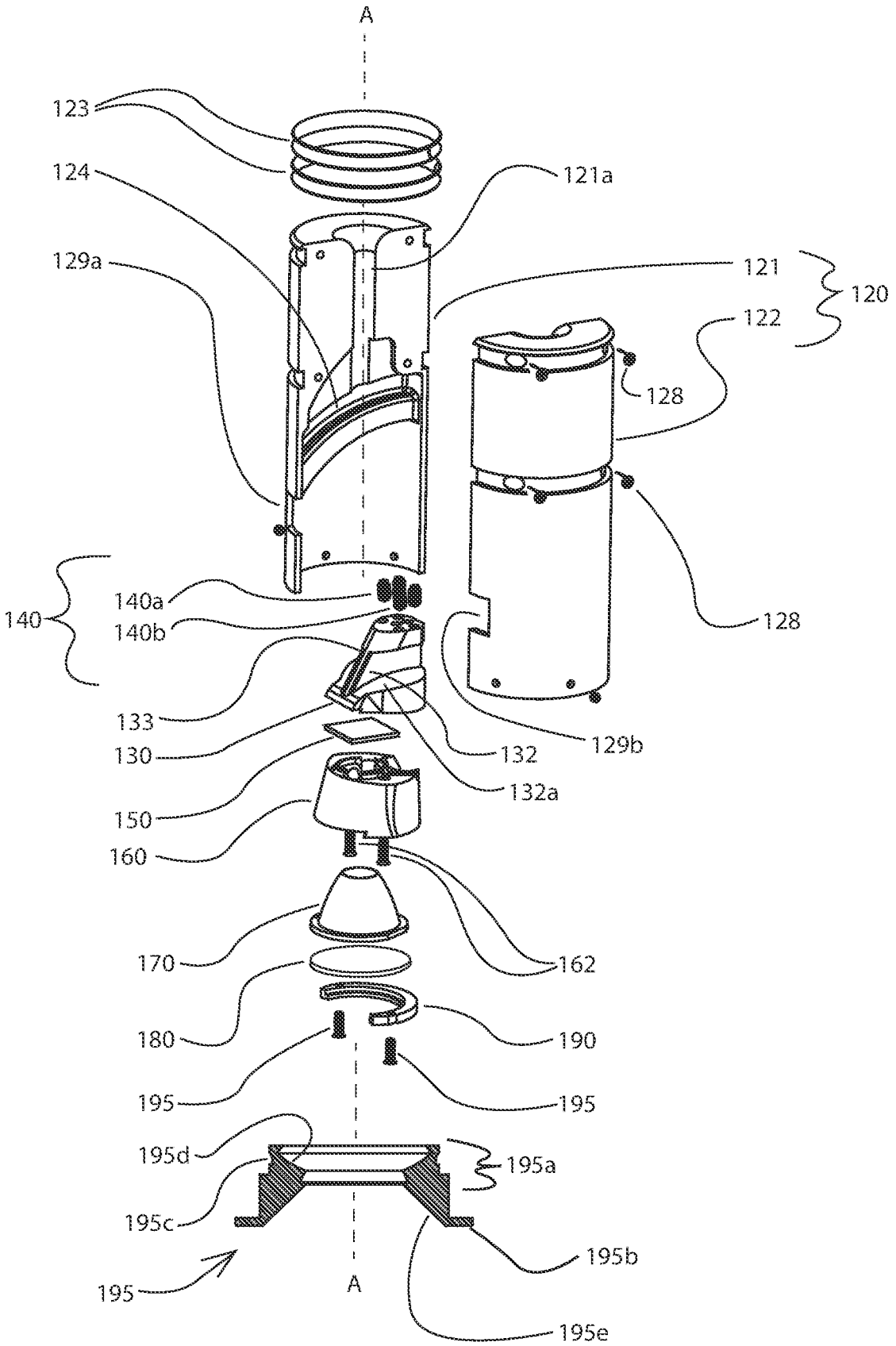
FIG. 7 is an exploded view of an example of a lighting device module of the lighting device system of FIG. 1

The lighting device module 102 is shown in side, cross-section views in FIGS. 5 and 6 and in an exploded view of FIG. 7. The lighting device module 102 includes a module housing 120 with an interior volume that contains and holds other components of the module, including a moveable heat sink member 130, one or more biasing devices 140, a light source 150, an optic holder 160, and an optic member 170. In some examples, the lighting device module 102 also includes a second optic member 180 and a second optic holder 190. In some examples, the lighting device module 102 also includes a trim member 195. In other examples, one or more (or each) of the second optic member 180, the second optic holder 190 or the trim member may be omitted. In the exploded view of FIG. 7, the above-mentioned components (and other components) of the lighting device module 102 are shown as separated along the axis A, and the module housing 120 is further shown as divided on a plane along the axis A.

In the example in FIGS. 1-7 the module housing 120 has a generally cylindrical shape, with a lengthwise dimension along a longitudinal axis A of the cylindrical shape, a round cross-section shape (taken perpendicular to the axis A), and two open ends. One end (the bottom end in FIGS. 1-7) may be open to allow light to pass outward, to allow access to components within the module housing 120 and, in some examples, to receive a trim member. A second end (e.g., the top end in FIGS. 1-7) may be open or partially open, or may be closed, in various examples. In certain examples, the second end has an opening through which one or more electrical conductors 196 extend, for connecting the light source 150 to an electrical driver circuit (e.g., the driver electronics 108).

In other examples, the module housing 120 may have other suitable shapes including, but not limited to cylindrical with other cross-section shapes (such as, but not limited to oval, rectangular or other polygonal or combined cross section shape), spheroid, cuboid, or the like. A cylindrical shape can be beneficial as being able to contain components of the lighting device module 102 described herein, yet also fit through a relatively small, round (or oval, rectangular or other polygonal) shaped hole in the panel 101, for installing or removing the lighting device module 102 to or from the lighting device system 100.

In certain examples (as shown in FIGS. 1-7), the module housing 120 is a two-part housing composed of a first housing side 121 and a second housing side 122 that connect together along the axial plane. The first and second housing sides 121 and 122 may connect together by any suitable connection mechanism including, but not limited to, threaded fasteners (as shown in FIG. 7), adhesives, welding, thermal bonding or other fasteners. In certain examples, one or more tensioned rings or bands 123 (e.g., metal or plastic bands) may be provided around the exterior surface of the module housing 120 (or within corresponding grooves formed in the exterior surface of the module housing) to hold or help hold the first and second housing sides 121 and 122 together. In such examples, the first and second housing sides 121 and 122 may be provided with one or more annular grooves on their outer surfaces, in which the tensioned rings or bands are recessed. In that manner, the rings or bands 123 may be recessed or partially recessed in the grooves in the outer wall surface of the module housing 120, to avoid or reduce increasing the diameter dimension of the module housing 120 (and, therefore, to avoid or reduce increasing the diameter or dimension of the opening in the panel 101 through which the module housing 120 may slide). Alternatively or in addition, the rings or bands 123 may be sufficiently recessed within the grooves in the first and second housing sides 121 and 122 to allow the outer surface of the module housing 120 to abut, flush against a contact surface of the heat sink member 104, when the lighting device module 102 is installed in the lighting device system 100, as described in further detail, below.

A two part housing can help to simplify manufacturing or assembly (or both) of the module housing 120. For example, a two part housing can be easier to form in a mold or by machining, as compared to a single, unitary component. A two part housing can form a clamshell-like housing structure that is easily connected together to contain and hold other components of the lighting device module 102. However, in other examples, the module housing 120 may be made as a single, unitary component, or may be made of more than two parts.

The module housing 120 (including the first and second housing sides 121 and 122) may be made by any suitable manufacturing process or processes including, but not limited to molding, machining, extrusion, or combinations thereof. The module housing 120 (including the first and second housing sides 121 and 122) may be made of any suitably rigid material or materials including, but not limited to metal, plastic, ceramic, composite material, or combinations thereof. In particular examples, the module housing 120 is made of a material having a good (relatively high or fast rate) of thermal dissipation capabilities such as, but not limited to a heat dissipating metal, plastic, ceramic or composite material.

The housing module 120 includes one or more rails or tracks (e.g., the rails or tracks 124 and 125 in the illustrated example) to guide the moveable heat sink member 130 along a path of motion, for adjusting a tilt direction of the light source 150 and, thus, the direction of light emission from the light source 150. In the illustrated example, each housing side 121 and 122 has a respective rail or track 124 or 125 such that, when the housing sides 121 and 122 are connected together, the rails or tracks 124 and 125 engage and support the moveable heat sink member 130 through a range of motion.

As described in further detail, below, the rails or tracks 124 and 125 protrude radially inward from an inner surface of the housing sides 121 and 122, respectively (partially into the interior volume defined by the housing sides 121 and 122). The rails or tracks 124 and 125 are configured to interface with the moveable heat sink member 130 to support and hold the heat sink member 130 within the module housing 120, yet allow the heat sink member 130 to be moved along a curved or an arced path, to adjust a tilt direction or angle of the light source 150 (and of a light emitting direction of the light source 150). In particular examples, the heat sink member 130 is supported to be moved (relative to the module housing 120) along the curved or arced path, within a range from a first position (as shown in FIG. 5) to a second position (as shown in FIG. 6), or to one or more (or any) further position between the first and second positions.

The moveable heat sink member 130 includes a heat sink body that has a shape and configuration to fit within the interior volume of the module housing 120, when the housing sides 121 and 122 are connected together. The body of the moveable heat sink member 130 may be made of a material having good (relatively high or fast rate) thermal dissipating capabilities such as, but not limited to a heat dissipating metal, plastic, ceramic or composite material, or combinations thereof. In certain examples, the moveable heat sink member 130 is composed of a single, unitary body of such material, for improved heat dissipating capabilities. In particular examples, the body of the moveable heat sink member 130 is made of a generally solid, unitary piece of material that is configured as described herein.

The body of the moveable heat sink member 130 has a mounting surface (the downward-facing surface in FIGS. 5-7) on which the light source 150 is secured. The light source 150 is secured to the surface of the moveable heat sink member 130 and oriented to emit light in a direction toward the optic member 170. In certain examples, that surface of the moveable heat sink member 130 may have a recess in which the light source 150 is received. The light source 150 may be attached to the heat sink member 130 by any suitable connection mechanism including, but not limited to adhesives, welding, friction fitting, clamps or other fasteners. In certain examples, an annular or partially annular frame member (not shown) attaches to the moveable heat sink member 130 and holds the light source 150 against the surface of the heat sink member, between the frame member and that surface.

In particular examples, the body of the moveable heat sink member 130 includes one or more channels or grooves through which one or more electrically conductive wires or other electrical conductors 196 may extend. The one or more conductors 196 may be electrically connected to the light source 150 and may extend through or along the moveable heat sink member 130, and through an opening in the module housing 120 (e.g., in the upper end of the module housing in FIG. 3-7), for connection to the driver electronics 108.

The light source 150 may include any suitable light emitting device or devices. In particular examples, the light source 150 includes one or more LEDs or other light source that generates heat during operation. In such examples, the one or more LEDs (or other light source) may be mounted on a circuit board or other support structure. As described herein, the moveable heat sink member 130 is configured to conduct and dissipate heat away from the light source 150, which can significantly improve the efficiency and light output of the one or more LEDs (or other heat-generating light sources). While particular examples described herein include a light source 150 having one or more LEDs, other examples may include other suitable light sources such as, but not limited to one or more halogen, halide, fluorescent, or incandescent light sources, or other electrical discharge or electroluminescence device, or the like In particular examples, the light source 150 is fixed to and mounted in thermal communication with the mounting surface of the moveable heat sink member 130, such that the heat sink member 130 may efficiently receive and conduct heat from the light source 150. In certain examples, the surface of the moveable heat sink member 130 may be in direct contact with the light source 150, to efficiently transfer heat away from the light source 150. In certain examples in which the light source 150 includes a circuit board on which one or more light emitting devices are mounted, the circuit board may be mounted in direct contact with (e.g., generally flat or flush against the mounting surface of the heat sink member 130) to enhance the ability to transfer heat from the circuit board (or components on the circuit board) to the heat sink member 130.

The optic holder 160 may comprise an annular body, frame, housing or other structure that is configured to hold and retain the optic member 170 and to connect and be fixed to the moveable heat sink member 130 (or to the frame that holds the light source 150 on the heat sink member 130). The optic holder 160 may be made of any suitable rigid material or materials including, but not limited to plastic, metal, ceramic, composite material, or combinations thereof. The optic holder 160 may be made by any suitable manufacturing process including, but not limited to molding, machining, extrusion, or combinations thereof. The optic holder 160 may be secured to the moveable heat sink member 130 (or to the frame) by any suitable connection mechanism including, but not limited to, threaded fasteners 162 (as shown in FIG. 7), adhesives, welding, thermal bonding, other fasteners or combinations thereof.

The optic member 170 may be a lens, filter, or other optical device that passes light, and affects a characteristic of the light being passed. In certain examples, the optic member 170 includes a lens configured to focus light toward one or more focus points or centers of focus. In some examples, the optic member 170 may have a configuration for directing light through a relatively small aperture or opening in the trim member 195. Some examples of such optic members that may be employed for optic member 170 are described in the Applicant's U.S. Pat. No. 10,900,654 (which is incorporated herein by reference, in its entirety). In other examples, the optic member 170 may include other suitable lens configurations.

In particular examples, the optic member 170 has a light-receiving side that faces the light source 150 and is configured to receive (and receives) light generated from the light source 150. The optic member 170 also has a light-emitting side that faces the open end (the downward-facing end in FIGS. 5-7) of the module housing 120, configured to emit (and which emits) light passing through the optic member 170. In some examples, the side surface or surfaces of the optic member 170 between the light receiving side and the light emitting side of the optic member 170 are coated or provided with a light reflective surface for internally reflecting light within the optic member 170.

The second optic member 180 may be a lens, filter, or other optical device that passes light, and affects a characteristic of the light being passed. In certain examples, the second optic member 180 includes a Fresnel lens, or other lens that spreads or evens out light passing through the lens. The second optic holder 190 may be an annular or semi-annular body or bracket configured to attach to the optic holder 160 and hold and retain the second optic 180 in a fixed position between the second optic holder 190 and the optic holder 160. The second optic holder 190 may be attached to the optic holder 160 by any suitable connection mechanism including, but not limited to, threaded fasteners 192 (as shown in FIG. 7), adhesives, welding, thermal bonding, other fasteners or combinations thereof. The second optic holder 190 may be made of any suitably rigid material including, but not limited to metal, plastic, ceramic, composite material or combinations thereof. In particular examples, the first and second optic members 170 and 180 may be made of any suitably transparent or partially transparent material such as, but not limited to, plastic, glass, ceramic, or combinations thereof.

When assembled as shown in FIGS. 5 and 6, the second optic holder 190, the second optic member 180, the optic member 170, the optic holder 160 and the light source 150 are connected in a fixed relation with the body of the moveable heat sink member 130. Accordingly, as the body of heat sink member 130 moves along the tracks or rails 124 and 125, those components move with the heat sink member 130.

The body of the moveable heat sink member 130 has a first groove or channel 132 extending transverse to the direction of the axis A, on one side of the body with respect to the axis A. The body of the moveable heat sink member 130 may have a second groove or channel 133 (corresponding to the groove or channel 132) on the opposite side of the body with respect to the axis A. The grooves or channels 132 and 133 are configured to receive the rails or tracks 124 and 125 protruding from the housing sides 121 and 122, respectively, when the housing sides 121 and 122 are connected together. When the rails or tracks 124 and 125 are received within the grooves or channels 132 and 133, the body of the heat sink member 130 is retained and held within the module housing 120, and may be slid along the rails or tracks 124 and 125, to change the tilt direction of orientation or the position of the heat sink member 130 relative to the axis A of the module housing 120 (and of the module 102).

In particular examples, the rails or tracks 124 and 125 are configured to engage and contact one or more of the walls of the grooves or channels 132 and 133 in the heat sink member 130, and to remain engaged and in contact throughout the range of motion of the heat sink member 130 relative to the module housing 120. In other examples, other portions of the body of the heat sink member 130 are configured to engage and contact (and remain engaged and in contact) with the housing sides 121 and 122, during or throughout the range of motion of the heat sink member 130. In certain examples, those features engage in sufficient thermal contact to provide a good (relatively high or fast rate of) thermal conduction for the transfer of heat from the heat sink member 130 to the housing sides 121 and 122, for dissipation as described herein. Accordingly, heat generated by the light source 150 may be transferred to the moveable heat sink member 130, and from the heat sink 130 to the housing sides 121 and 122, for dissipation. By providing a good thermal contact between the light source 150 and the moveable heat sink member 130, and also between the walls of the grooves or channels 132 and 133 in the heat sink member 130 and rails or tracks 124 and 125 in the module housing 120 throughout the range of movement of the heat sink member 130, thermal energy may be conducted away from the light source 150 relatively quickly, while also allowing the heat sink member 130 (with the light source 150) to be moveably adjustable within the module housing 120.

In particular examples, the moveable heat sink member 130 includes or operates with one or more biasing members 140 configured to force at least one wall of the groove or channel 132 and at least one wall of the groove or channel 133 against a surface of the rail or track 124 and a surface of the rail or track 125, respectively. By forcing the groove or channel surfaces of the heat sink member 130 against the rail or track features of the housing sides 121 and 122, the moveable heat sink member 130 may be held in good thermal communication with the module housing 120, while allowing the heat sink member 130 to be adjustably slid along the rails or tracks 124 and 125.

In the example in FIGS. 1-7, the one or more biasing members 140 include one or more (four shown in FIG. 7) ball plunger mechanisms (two labeled 140*a* one on the groove 132 side of the heat sink member 130, and two others labeled 140*b* on the groove 133 side of the heat sink member 130 in FIG. 7). Each ball plunger mechanism 140*a* and 140*b* has a spring-biased ball or plunger that is arranged to press against a surface (the upward-facing surface in FIG. 7) of one of the rails or tracks 124 or 125. Each first one of the ball plunger mechanisms 140*a* may have a spring-biased ball or plunger extending partially out of a surface (e.g., the upper surface) of the groove or channel 132, to engage a surface (e.g., the upper surface) of the rail or track 125. Each second of the ball plunger mechanisms 140 may have a spring-biased ball or plunger extending partially out of a surface of the groove or channel 133, to engage a surface (e.g., the upper surface) of the rail or track 124.

The first ball plunger mechanisms 140 may press against the upper surfaces of the rail or track 125 and force the bottom surface 132*a* of the groove or channel 132 against the bottom surface of the rail or track 125. Similarly, the second ball plunger mechanisms 140 may press against the upper surfaces of the rail or track 124 and force the bottom surface (out of view in FIG. 7, but corresponding to 132*a*) of the groove or channel 133 against the bottom surface of the track or rail 124. In that manner, the bottom surfaces of the groove or channels 132 and 133 in the heat sink member 130 are pressed against the bottom surfaces of the rails or tracks 124 and 125 of the housing sides 121 and 122, for improved thermal contact and frictional engagement of the heat sink member 130 with the module housing 120.

During assembly, the first and second ball plunger mechanisms 140*a* and 140*b* may be inserted and secured within corresponding passages drilled or otherwise formed through sections of the heat sink member 130 (e.g., the sections that overhang the grooves or channels 132 and 133 in FIG. 7). A portion of one of the spring-biased balls or plungers extends out of each passage and partially into each groove or channel 132 and 133. The spring-biased balls or plungers extend into the grooves or channels 132 and 133 a sufficient distance to engage and press against the upper surface of the rails or tracks 124 and 125, when the heat sink member 130 is engaged with the rails or tracks 124 and 125.

In other examples, more than one ball plunger mechanism 140*a* and 140*b* may be provided for each groove or channel 132 and 133. In other examples, instead of (or in addition to) ball plunger mechanisms extending from the upper wall, one or more ball plunger mechanisms 140*a* and 140*b* may be provided on and extending from the lower wall of each groove or channel 132 and 133 in the heat sink member 130, to engage and press against the bottom surface of the rails or tracks 124 and 125 and force the top surfaces of those rails or tracks against the upper surfaces of the grooves or channels 132 and 133. Yet other examples may include other mechanisms for biasing one or more surfaces of the grooves or channels 132 and 133 against one or more surfaces of the rails or tracks 124 and 125 for improved thermal coupling and/or frictional engagement including, but not limited to, one or more springs, spring material, resilient material, magnetic coupling or combinations thereof.

In the illustrated example, the rails or tracks 124 and 125 protrude radially inward from an inner wall of each of the housing sides 121 and 122 while a groove or channel 132 or 133 is provided on each side of the body of the heat sink member 130. In other examples, the location of each of the rail or track 124 and groove or channel 132, 133 may be reversed, such that the housing sides 121 and 122 have grooves or channels 132 and 133 respectively, while each side of the body of the heat sink member 130 has a protruding rail or track 124 or 125 that engages the groove or channel 132 or 133. Other examples employ other suitable movable mounting configurations for retaining and holding the heat sink member 130 within the module housing 120 for movement along an arced path.

In the illustrated example, the rails or tracks 124 and 125 are curved (e.g., curved downward, toward the left of the housing side 121 in FIG. 7, or curved downward, toward the right of the housing side 122 in FIGS. 5 and 6). In other examples, the curvature may be toward the opposite direction or may be centered relative to the axis A. In certain examples, the curvature of the rails or tracks corresponds to an arc portion of a circle. In particular examples, that circle has a center that corresponds to a center of focus or an optical focal point of the optic member 170.

In certain examples (as shown in FIGS. 5 and 6), the center of focus or optical focal point of the optic member 170 may be in or near a light opening in the trim member 195 of the lighting device module. Accordingly, by supporting the heat sink member 130 for movement along an arc that corresponds to the optical focal point, the optic member 170 may direct a majority of emitted light through a relatively small opening in the trim member 195. Therefore, the opening in the trim member 195 may be made relatively small, without significant interference with the light output of the lighting device module 102.

In the example in FIGS. 1-7, the arc of each rail or track 124 and 125 is about a 30 degree arc of a circle. In the example in FIGS. 1-7, the arc of each rail or track 124 and 125 extends from a vertical radial position (shown on the left side of FIGS. 5 and 6, and on the right side of FIG. 7), to a 30 degree radial position (as shown on the right side of FIGS. 5 and 6, and on the left side of FIG. 7). In other examples, the arc may have another suitable angle, for example, any angle within the range of up to 45 degrees.

When the moveable heat sink member 130 is in a first position (as shown in FIG. 5), a side of the heat sink member 130 may abut an inner surface of the module housing 120 on the left side of the rail or track 125. In that position, the heat sink member 130 is oriented such that the light source 150 (and the heat sink surface on which the light source 150 is mounted) is substantially (or close to being) centered relative to the axis A and is oriented to direct light in the axial direction A (vertically downward in FIG. 5). When the moveable heat sink member 130 is in a second position (as shown in FIG. 6), a second (opposite) side of the heat sink member 130 may abut an inner surface of the module housing 120 on the right side of the rail or track 125. In that position, the heat sink member 130 is oriented such that the light source 150 (and the heat sink surface on which the light source 150 is mounted) directs light in a direction that is at an angle of about 30 degrees relative to the axial direction A (as shown in FIG. 6).

In certain examples, the body of the moveable heat sink member 130 may be configured with the second side (the right-facing side in FIGS. 5 and 6) defining an angle relative the first side (or relative to the axis A when the heat sink member 130 is in the first position in FIG. 5). The angled second side of the heat sink member 130 can increase the angle (and range of angles) at which heat sink member 130 (and the light source 150) may be oriented within the module housing 120, while reducing (or not requiring an increase) in the diameter or size of the module housing 120. In particular examples, the angle of the second side of the heat sink member 130 relative to the axis A (or to the first or left side in FIGS. 5 and 6) of the heat sink member 130 defines the maximum angle at which the heat sink member 130 (and the light source 150) may be oriented within the module housing 120. For example, a 30 degree angle of the second side of the heat sink member 130 relative to the axis A (or to the first side) can allow the light emitting direction of the light source 150 on the heat sink member 130 to reach a maximum of a 30 degree angle relative to the axis A. In other examples, the second side of the heat sink member 130 may define an angle that is greater or less than 30 degrees, to allow for other maximum adjustment angles suitable for a desired context of use.

Alternatively or in addition, the module housing 120 may be provided with one or more openings 129 or other features for increasing the angle (and range of angles) at which heat sink member 130 (and the light source 150) may be oriented within the module housing 120, while reducing (or not requiring an increase) in the diameter or size of the module housing 120. In the example in FIGS. 1-7, an opening 129 in the module housing 120 is arranged adjacent one end of the rails 124 and 125, on a side of the module housing 129 at which the heat sink member is at its maximum angle (e.g., the 30 degree radial angle in FIG. 6). The opening 129 is at a location at which a portion of the heat sink member 130 would otherwise contact the module housing 120 and inhibit further angular movement beyond its position at contact. However, by virtue of the location of the opening 129, that portion of the heat sink member 130, instead, passes at least partially into the opening 120 to increase the maximum angle of the heat sink member 130 (when the heat sink member 130 is in the second position shown in FIG. 6).

In other examples, a further opening may be provided in the module housing 120, on the opposite end of the rails 124 and 125, for example, to allow additional sliding movement of the heat sink member 130, beyond the vertical orientation shown in FIG. 5. In the example in FIGS. 1-7, the opening 129 is formed with a partial opening or slot 129*a* on the housing side 121 and a further partial opening or slot 129*b* on the housing side 122. The partial openings or slots 129*a* and 129*b* are aligned together to form the opening 129, when the first and second housing sides 121 and 122 are connected together. In other examples, the opening 129 may be formed on one, but not the other of the housing sides 121 and 122.

As described above, openings or other features of the module housing 120, as well as the arc of the rail or tracks 124 and 125, or the shape and configuration of the heat sink member 130 (or any combination thereof), can be configured to define a desired range of possible tilt adjustment motion of the heat sink member 130 and of the light source 150 relative to the axis A of the lighting device module 102. Accordingly, various examples embodiments include module housings 120, rails or tracks 124 and 125 and heat sink members 130 having configurations as described herein, to provide a desired range of motion and accommodate a desired range of tilt adjustment.

In particular examples, the rails or tracks 124 and 125 in the module housing 120 and the grooves or channels 132 and 133 in the heat sink member (or other portions of those components) are in sufficiently tight engagement and friction fitted with each other to retain and hold the heat sink member 130 in any position on the rails or tracks 124 and 125 between and including the first and second positions in FIGS. 5 and 6. In particular examples, the retention force between those components is enhanced by the biasing device 140. In certain examples, the retention force is sufficient to retain and hold the heat sink member 130 against gravity, but may be overcome and allow the heat sink member 130 to be slid and moved along the rails or tracks 124 and 125, by applying a manual force. The manual force may be applied by a user reaching a hand or one or more fingers through an open end of the module housing 120 (the downward-facing end in FIGS. 5 and 6), contacting and applying directed force to the optic holder 160 (or to the optic member 170, the second optic member 180 or the second optic holder 190). In other examples, a force may be applied by extending a tool through the open end of the module housing 120 to contact and apply a directed force as described above.

In certain examples, the trim member 195 is provided for connection with the open end (the bottom end in FIGS. 1-7) of the module housing 120. In particular examples, the trim member 195 includes an annular body that has a first section 195*a* configured to fit at least partially within the open end of the module housing 120, and a second section 195*b* that is configured to remain outside of the module housing 120. The annular body of the trim member 195 defines a central opening through which light may pass, when the trim member 195 is installed on the module housing 120. The body of the trim member 195 may be made of any suitably rigid material such as, but not limited to plastic, metal, ceramic, composite material or combinations thereof.

The central opening of the trim member may define an angled or partial-conical inner surface that tapers outward from a smaller diameter toward the interior of the module housing 120 and a larger diameter facing away from the module housing 120. In some examples, the tapered inner surface of the trim member 195 may be formed or coated with a reflective material for reflecting light emitted through the optic member 170. In other examples, the tapered inner surface of the trim member 195 may be formed or coated with a non-reflective material or a light absorbing material.

The first section 195*a* of the trim member 195 may include one or more connection features 195*c* that engage with one or more connection features on the module housing 120 to attach and secure the trim member 195 to the module housing 120. The one or more connection features may include, but are not limited to, one or more grooves 195*c* on the trim member 195 (or on the module housing 120) that engage one or more corresponding protrusions on the module housing 120 (or on the trim member 195) in a snap-fit manner. In other examples, other suitable connection features may be employed including adhesives, friction fitting, magnetic coupling, spring clamps or other fasteners or clamps, or combinations thereof.

The first section 195*a* of the trim member 195 may include a recess defined by an inwardly curved or tapered wall 195*d*. The recess has a wider opening at the open end (the upper end in FIGS. 3-7) and a narrower opening toward the opposite end (the lower end in FIGS. 3-7). The recess within the wall 195*d* receives a portion of the optic holder 160 or of the optic member 170 (or both) when the heat sink member 130 is moved to the second position (as shown in FIG. 6). The recess within the wall 195*d* allows the first section 195*a* of the trim member 195 to extend a sufficient distance into the open end of the module housing 120 (e.g., to allow engagement of the connection features), without interfering with or blocking the heat sink member 130 from being moved to the second position.

In particular examples, the surface of the recess in the wall 195*d* of the trim member 195 has a curvature or angle that is configured to reflect a peripheral portion of light that is emitted through the trim member 195, such that the reflected peripheral edge portion is reflected back into the lighting device module 102, toward the optic 170 or toward the inner wall surface of the module housing 120 and absorbed. In that manner the pattern of light that is emitted through the trim member 195 can be sharper with more a more defined edge, as compared to a pattern in which the peripheral edge portion is not reflected back.

In certain examples, the second portion 195*b* of the trim member 195 may include a lip feature that extends radially outward from the rest of the module housing 120, for example, to cover a gap or opening between parts, after installation. In certain examples, the second portion 195*b* of the trim member 195 may be in a viewable location after installation of the lighting device system and, thus, may be made of or provided with a decorative material, coating, color, or other aesthetic enhancement.

The second portion 195*b* of the trim member 195 may include a further curved or angled surface 195*e* that extends from the narrower opening of the recess in the wall 195*d* to a second open end (the lower end in FIGS. 3-7). The further curved surface has a wider opening at the open second end (the lower end in FIGS. 3-7) and a narrower opening toward the opposite end (the upper end in FIGS. 3-7). In certain examples, the further curved or angled surface 195*e* is reflective (and has a reflective material, coating or treatment) to reflect light. In other examples, the further curved or angled surface 195*e* may be black or light absorbing (and have a black or light absorbing material, coating or treatment).

In some examples, the second portion 195*b* of the trim member 195 may include an extended lip feature (e.g., larger than the lip shown in FIGS. 1-7) that includes a plurality of openings for receiving one or more plaster-like materials, such as, but not limited to materials commonly known or used as plaster, joint compound, spackling, drywall mud, gypsum-based paste, putty, or the like (collectively and individually referred to herein as plaster material). In certain examples, such openings may function or be configured as described in Applicant's U.S. Pat. No. 10,900,654 (cited and incorporated herein, above), with reference to the openings in the third heat sink member 106 in that patent. In other examples, the lip feature of the trim member 195 may have other suitable configurations of openings, for receiving plaster material.

In those examples, once the trim member 195 is connected and the lighting device module 102 is installed, the plaster material may be applied to the exposed surface of the lip of the trim member 195 and a portion of the exposed surface of the panel 101 by any suitable technique, including, but not limited to spreading the material manually, for example with a spatula or other spreading tool. The plaster material may be forced through the openings in the lip of the trim member 195, to help hold and retain the plaster material to the trim member or to help conceal the trim member 195 on a ceiling, wall or other structure. In certain examples, the plaster material is configured to be applied in a wet or paste-like form, and dry or solidify after being applied to the lip of the trim member 195.

The components of the lighting device module 102 may be made by any suitable manufacturing processes, including those described herein. The components may be assembled by securing the optic member 170 in the optic holder 160. In addition, the light source 150 is secured to the mounting surface (the downward-facing surface in FIGS. 5-7) of the heat sink member 132. The assembled optic member 170 and optic holder 160 may be secured to the heat sink member 132 (or to a frame member that attaches the light source 150 to the heat sink member), over the light source 150, such that the light inlet side of the optic member 170 faces the light emission side of the light source 150. In some examples, the second optic member 180 may be secured to the optic holder 160 by the second optic holder 190.

The heat sink member 130, with the above-mentioned components assembled thereon, is placed in one housing side 121 or 122, with one of the grooves or channels 132 or 133 in alignment and engagement with one of the rails or tracks 124 and 125 (and with a biasing device 140 engaged with that rail or track as described herein). In addition, the electrical conductors 196 extending from the heat sink member 130 are aligned with and placed in one or more channels or grooves (e.g., channel 121*a*) in the housing side 121 or a similar channel in housing side 122. Those channels define conductor passages through the module housing 120, when the housing sides 121 and 122 are connected together). Then, the other housing side 121 or 122 is placed over the heat sink member 130 (and over above-mentioned components that are assembled on the heat sink member), with the other groove or channel 132 or 133 in alignment and engagement with the other rail or track 124 or 125 (and with another biasing device 140 engaged with that rail or track as described herein). In that arrangement, one or more screws or other fasteners 128 may be inserted through fastener openings in one of the housing sides 121 or 122 and threaded (or otherwise attached) to one or more corresponding openings (or other connection feature) on the other housing side 121 or 122. Alternatively or in addition, one or more tensioned rings or bands 123 may be placed around the outer peripheral surface of assembled housing sides 121 and 122 to retain or help retain the housing sides together.

In certain examples, the assembled lighting device module 102 may be electrically connected to the driver electronics 108, via the electrical conductors 196. Before or after connecting the lighting device module 102 to the driver electronics 108, the assembled lighting device module 102 may be inserted through an opening formed in a panel 101, for installing the lighting device module 102 in a ceiling, wall or other structure. In particular examples, the driver electronics 108 may be installed on the panel 108, or on a base plate 110 that is configured to be supported (or is supported) on the panel 108 (such as, but not limited to, a side of the panel 108 that is within or facing toward an attic or ceiling space, an inner wall space, a plenum or duct space or the like.

In particular examples, the driver electronics 108, as well as the biasing device and the heat sink member 104 are installed on a surface of the panel 101, for example during or after construction of a ceiling, wall or other structure. In some examples, those components may be mounted on the base plate 110 (which may be mounted to the surface of the panel 101) and, in further examples, the cover member 112 may be mounted over those components. The heat sink member 104 may be mounted and supported adjacent an opening in the panel 101. As discussed herein the opening in the panel 101 has a size and shape through which the assembled module housing 120 may fit (for example, by sliding the assembled module housing 120 through the opening in the panel 101 and into the lighting device system 100 (e.g., in the axial A direction, or upward direction of FIG. 4). In other examples, the lighting device module 102 may be installed separately (without other components of the lighting device system 100 described herein) or may be installed in other suitable lighting device systems, and electrically connected to suitable driver electronics for operation.

Other Components of the Lighting Device System 100

The heat sink member 104 includes a heat sink body be made of a material having good (relatively high or fast rate) thermal dissipating capabilities such as, but not limited to a heat dissipating metal, plastic, ceramic or composite material, or combinations thereof. In certain examples, the heat sink member 104 is composed of a single, unitary body of such material, for improved heat dissipating capabilities. In particular examples, the body of the heat sink member 104 is made of a generally solid, unitary piece of material that is configured as described herein. In some examples, as illustrated, the body of the heat sink member 104 may include one or more (or a plurality of) fins or other shaped features to help dissipate heat from the body of the heat sink member 104.

The body of the heat sink member 104 has a mounting surface (the bottom surface in FIG. 2) that is supported on a surface of the base plate 110 or on a surface of the panel 101 (i.e., the upward-facing surfaces in FIG. 2). In particular examples, the mounting surface of the heat sink member is generally flat or otherwise configured to abut against a flat surface of the base plate 110 or the panel 101. The heat sink member 104 may be secured to the base plate 110 or the panel 101 by any suitable connection mechanism such as, but not limited to adhesives, welding, friction fitting, clamps or other fasteners. In the example in FIG. 2, threaded fasteners 200 and 202 extend through channels in the body of the heat sink member 104 and thread into corresponding threaded nuts or threaded apertures (not shown) on or adjacent the base plate 110 or the panel 101.

The body of the heat sink member 104 has at least one contact surface 104*a* that is arranged to abut and contact a portion of the outer surface of the module housing 120, when the lighting device module 102 is installed in the lighting device system 101. In particular examples the contact surface 104*a* extends transverse (such as, but not limited to perpendicular to) the mounting surface of the heat sink member 104, and is arranged to abut along a side portion of the module housing 120.

In the example in FIGS. 1-4, the contact surface 104*a* is a curved surface defining a partial cylindrical recess along one side of the heat sink member 104. In particular examples, the curvature of the contact surface 104*a* has a radius or other shape that is the same (or about the same) as the radius of curvature or shape of the outer surface of the module housing 120, such that the module housing 120 fits partially within the recess of the curved contact surface 104*a*, and abuts, flush, with the contact surface 104*a*, when the lighting device module 102 is installed in the lighting device system 101. In certain examples as shown in FIGS. 1-4, the module housing 120 is configured to abut the contact surface 104*a* along the entire (or substantially the entire) axial length dimension of the module housing 120.

The module housing 120 is configured to abut and contact the contact surface 104*a* of the heat sink member 104 to transfer heat from the module housing 120 to the heat sink member 104. The amount of surface area of the module housing 120 in contact with the contact surface 104*a* of the heat sink member 104 (and, thus, the heat transfer capability) is increased by one or both of the curvature of the contact surface 104*a* extending around a portion of the module housing 120, or the axial length of the contact surface 104*a* extending along the entire (or substantially the entire) axial length of the module housing 120.

In the example in FIGS. 1-4, the biasing device 106 is arranged to impart a bias force on the module housing 120 directed to force or press the module housing 120 against the contact surface 104*a* of the heat sink member 104, when the lighting device module 102 is installed in the lighting device system 101. The biasing device 106 may be mounted on the base plate 110 or on the panel 101, adjacent the opening through which the lighting device module 102 is received. In other examples, the biasing device 106 may be mounted on the cover 112 or on another component in the lighting device system 101.

The biasing device 106 may include a spring, a spring-biased plunger, a spring biased ball, a resilient material or other structure that is configured to abut against the outer surface of the module housing 120 of the lighting device module 102 and push the module housing 120 toward the contact surface 104*a* of the heat sink member 104, when the lighting device module 102 is installed in the lighting device system 101. In the illustrated example, the spring and plunger or ball are supported in a plunger housing that is secured to the base plate 110 or to the panel 101 by any suitable connection mechanism including, but not limited to adhesives, welding, threaded fasteners, clamps, or other fasteners.

In the example in FIGS. 1-4, the driver electronics 108 are secured to the base plate 110 or to the panel 101 by a bracket 109 and threaded fasteners. In other examples, the driver electronics 108 may be secured to the base plate 110 or to the panel 101 by other suitable connection mechanisms including, but not limited to adhesives, welding, clamps, or other fasteners. In yet other examples, the driver electronics 108 may be secured to the cover member 112 or to another component in the lighting device system 100.

The driver electronics 108 electrically connect with the light source 150 in the lighting device module 102, through the conductors 196. The driver electronics 108 also electrically connect with a source of electrical power through further conductors 197. The further conductors 197 may connect to an AC power line or other power source that is provided in the ceiling, the wall or the other structure in which the lighting device system 100 is installed. In the illustrated example, the further conductors 197 comprises electrical wire conductors that extend from the driver electronics 108 to electrical connectors that electrically couple the further conductors 197 to AC power source conductors present in an installation environment. The driver electronics 108 are configured to convert power provided through the conductors 197 from the power source, to a suitable power for driving the light source 150.

In particular examples, the light source 150 includes an LED, and the driver electronics 108 includes one or more LED drivers to drive the LED light source 150. In some examples, the driver electronics 108 (or other electronics within the lighting device system 100) may include a processor to execute instructions stored on memory (e.g., non-transient computer readable media) to process data and/or to control various functions of the lighting device (e.g., temperature, light output, color of light, direction of light, focus of light, and/or the like).

The components of the lighting device system 100 may be made by any suitable manufacturing processes, including those described herein. For example, a lighting device module 102 may be made and assembled as described above. The lighting device module 102 and other components of the lighting device system 100 may be assembled and installed on a panel 101 of a ceiling, a wall or another structure at an installation site, in any suitable assembly and installation process, such as but not limited to the following example.

Before or during assembly and installation, a light passage opening is formed in the panel 101, where the opening has a size and dimension to allow the lighting device module 102 to pass. In particular examples, the lighting device module 102 has a generally cylindrical shape with an outer diameter, and the opening in the panel is formed as a round shape with the same or slightly larger diameter as the outer diameter of the lighting device module 102 to allow the lighting device module 102 to be easily slid through the opening, in its axial direction. In other examples as described herein, the outer dimension of the lighting device module 102 may be oval, polygonal, or of other shapes, and the shape of the opening in the panel may be formed of a corresponding shape.

In some examples, the base plate 110 is provided. The base plate 110 has an opening of a size and shape that corresponds to the size and shape of the opening formed in (or to be formed in) the panel 101. The base plate 110 is mounted on one surface of the panel 101 (the upward-facing surface in FIGS. 1-4), with the opening in the base plate 110 aligned with the opening in the panel 101. In certain examples, the opening in the base plate 110 is larger than (and encompasses) the opening in the panel 101. In other examples, the opening in the base plate 110 is about the same size as, or smaller than the opening in the panel 101. In particular examples, the surface of the panel 101 on which the base plate 110 is mounted corresponds to an upward-facing surface of a ceiling panel or an inward-facing surface of a wall panel (in or facing toward an attic or ceiling space, an inner wall space, a plenum or duct space or the like).

The heat sink member 104 is mounted on a surface of the base plate 110 (the upward-facing surface in FIGS. 1-4), adjacent the opening in the base plate, with the contact surface 104*a* of the heat sink member 104 facing the opening. The one or more biasing device 106 is mounted to that same surface of the base plate 110, and is also arranged adjacent the opening in the base plate 110, but on the opposite side of the axis of the opening (on the diametrically opposite side of the opening) relative to the contact surface 104*a* of the heat sink member 104. The one or more biasing device 106 is arranged to direct a biasing force toward the contact surface 104*a* of the heat sink member 104.

The driver electronics 108 are mounted on the base plate 110. In certain examples, the driver electronics 108 is formed as a module, and the mounting bracket 109 secures the driver electronics module 108 to the same surface of the base plate on which the biasing device 140 is mounted. In other examples, the driver electronics 108 may be mounted to the cover 112 or another component.

The electrical conductors 197 from the driver electronics 108 are electrically connected to power source conductors provided at the installation site. In some examples, the power source conductors are passed through openings in the cover 112 and then connected to the electrical conductors 197 of the driver electronics 108. Then the cover 112 may be secured to the base plate 110, to enclose the driver electronics 108 and the heat sink member 104.

The driver electronics is electrically connected to the lighting device module 102, through the electrical conductors 196. In certain examples, the electrical conductors 196 include one or more electrical connectors 196*a* that allow a first section of the electrical conductors 196 extending from the driver electronic 108 to be connected with a second section of the electrical conductors 196 extending from the lighting device module 102. For example, the first section of the electrical conductors 196 may be passed through (or made accessible through) the aligned openings in the panel 101 and the base plate 110, before the cover 112 is attached to the base plate 110.

While the lighting device module 102 is located on the opposite side of the panel 101 relative to the driver electronics 108, the first section of the electrical conductors 196 may accessed through the aligned openings in the panel 101 and the base plate 110, and may be connected to the second section of the electrical conductors 196, via the electrical connectors 196*a*. In that manner, the lighting device module 102 may be electrically connected to the driver electronics 108, and the driver electronics may be electrically connected to power source conductors at an installation site In some examples, the electrical connector 196*a* may be inserted in (or may be fixed in) one of the housing sides 121 and 122 (or in an opening in the top of the module housing 120), as shown in FIGS. 3 and 4. In those or other examples, the electrical connector 196*a* may be configured to allow rotation of the lighting device module 102, without rotating (and winding) the conductors 196. For example, the electrical connector 196*a* may have a coaxial jack and plug configuration (similar to a jack and plug of a headphone) that allows the jack to be rotatable about an axis relative to the plug, while remaining electrically coupled. Other examples may include other rotatable, electrical connectors 196*a*. In those examples, the lighting device module 102 may be rotated about its axis A (e.g., for providing rotational adjustment of a light emitting direction), without winding the conductors 196.

Once the lighting device module 102 is electrically connected to the driver electronics 108, the lighting device module 102 may be positioned axially with the aligned openings, and may be slid through the aligned openings (e.g., in the upward direction in FIG. 4). As the lighting device module 102 slides into the aligned openings in the panel 101 and the base plate 110, the biasing device 106 engages the outer surface of the module housing 120 and forces the module housing 120 toward and against the surface contact surface 104*a* of the heat sink member 104. In certain examples, the lighting device module 102 may be slid (e.g., manually or with a tool) partially through the aligned openings in the panel 101 and the base plate 110 and, while still partially extending out from the panel, may be rotated about its axis A to a desired rotational adjustment position. In addition, the tilt angle of the light source 150 in the lighting device module 102 may be adjusted (before, during or after installation) as described above. The combination of the rotational adjustment and the tilt adjustment can allow a user to adjust a direction of the light emitted from the lighting device module 102 about multiple axis. In certain examples, the rotational and pivotal adjustability allows the light source 150 to direct light in a variety of different selectable directions.

Once the rotational adjusted position of the lighting device module 102 about the axis A is selected, the lighting device module 102 may be slid further into the aligned openings (e.g., manually or with a tool), until the lip or flange 195*b* of the trim member 195 engages (or is positioned adjacent) a surface of the panel 101 (the downward-facing surface in FIGS. 1-4). In that position, the lighting device module 102 is retained in the aligned openings in the panel 101 and the base plate 110, with the light source 150 of the lighting device module arranged to direct light out through the aligned openings and the trim member 195.

In certain examples, the lighting device module 102 is automatically secured in the lighting device system 100, by sliding the lighting device module 102 into the aligned openings in the panel 101 and the base plate 110. For example, the biasing device 106 may be configured to provide a sufficient bias force on the lighting device module 102 to retain the lighting device module 102 in the lighting device system 100 by frictional engagement with the biasing member and with the contact surface 104*a* of the heat sink member 104. In those examples, the frictional engagement may be sufficient to retain the lighting device module 102 (against gravity), but may be overcome by applying a force (e.g., a manual force or a force with a tool) in the axial direction to pull the lighting device module 102 out of (or partially out of) the aligned openings in the panel 101 and the base plate 110. In other examples, one or more other connection mechanisms may be employed to secure the lighting device module 102 in the lighting device system 100 including, but not limited to, other friction fitting configurations, snap connections, magnetic coupling, clamps, other fasteners, combinations thereof, or the like. In certain examples, plaster material may be spread over and pushed through openings in the lip portion of the trim member 195, as discussed above and in Applicant's U.S. Pat. No. 10,900,654 (cited and incorporated herein, above).

When the lighting device module 102 is connected to the driver electronics 108 and is secured in the lighting device system 100 as shown in FIG. 3, the lighting device module 102 may be energized to generate and direct light out through the aligned openings in the panel 101 and the base plate 110 and through the trim member 195. Adjustment (or further adjustment) of the tilt angle of the light emitted by the lighting device module 102 may be carried out by, for example, temporarily removing the trim member 195 and reaching into the open end of the lighting device module 102 to contact and apply tilting pressure on the optic holder 160 of the lighting device module 102, as described above.

In particular examples, during operation of the lighting device system 100, heat generated by the light source 150 of the lighting device module 102 is efficiently transferred away from the light source 150. As discussed above, in certain examples of the lighting device module 102, the light source 150 is mounted in good (relatively high or fast rate) of thermal communication with a mounting surface of the moveable heat sink member 130. The moveable heat sink member 130 is made of a material for good thermal conduction. In addition, the moveable heat sink member 130 is biased against the housing sides 121 and 122 (by the biased engagement of the rails or tracks 124 and 125 with the grooves or channels 132 and 133) to more effectively convey heat from the moveable heat sink member 130 to the module housing 120.

The module housing 120 is made of a material for good thermal conduction. In addition, the module housing 120 is pressed against the contact surface 104*a* of the heat sink member 104 by the biasing member 106, to more effectively convey heat from the module housing 120 to the heat sink member 104. The heat sink member 104 is made of a material for good thermal conduction and effectively draws heat from the module housing 120. In addition, the heat sink member is mounted in thermal contact with the base plate 110, to transfer heat from the heat sink member 104 to the base plate 110. The base plate 110 is mounted flat against the panel 101 and may transfer and dissipate heat to the panel 101 and into the environment on the other side of the panel 101. Accordingly, thermal energy may be efficiently transferred from the light source 150, to the base plate 110 and the panel 101, for dissipation. By improving the rate of transfer of heat away from the light source 150, the light source 150 may produce light more efficiently and may last longer.

As discussed above, in further examples, the base plate 110 may be omitted. In those examples, the heat sink member 104 may be configured to mount onto the panel 101 and to transfer heat directly to the panel 101, for dissipation by the panel 101. The heat sink member 104 may be connected to the panel 101 by any suitable connection mechanism including, but not limited to one or more drywall fasteners, threaded fasteners, adhesives, clamps, or other fasteners (e.g., represented by fasteners 200 and 202).

While the example shown in FIGS. 1-7 includes one lighting device module 102, other examples may include two or more lighting device modules 102 (for example, that are received in a corresponding two or more sets of aligned openings in the base plate 110 and the panel 101, or are received in a single, larger set of aligned openings in the base plate 110 and the panel 101). In those examples, the lighting device system may include a corresponding two or more heat sink members 104 (matched one-to-one with the two or more lighting device modules). Further, those examples may include a corresponding two or more biasing members 106 (matched one-to-one with the two or more lighting device modules) and a corresponding two or more driver electronics 108 (matched one-to-one with the two or more lighting device modules).

An example of a lighting device system 200 having multiple lighting device modules is shown in FIGS. 8-12. In those drawings, four lighting device modules $\mathbf{102}_1$, $\mathbf{102}_2$, $\mathbf{102}_3$ and $\mathbf{102}_4$ are shown. In other examples, the lighting device system 200 may be configured with two, three or more than four lighting device modules 102. Each of the lighting device modules $\mathbf{102}_1$, $\mathbf{102}_2$, $\mathbf{102}_3$ and $\mathbf{102}_4$ in FIGS. 8-12 may correspond to the lighting device module 102 described with regard to FIGS. 1-7 (excluding the trim member 195, in some examples).

Figure 8:
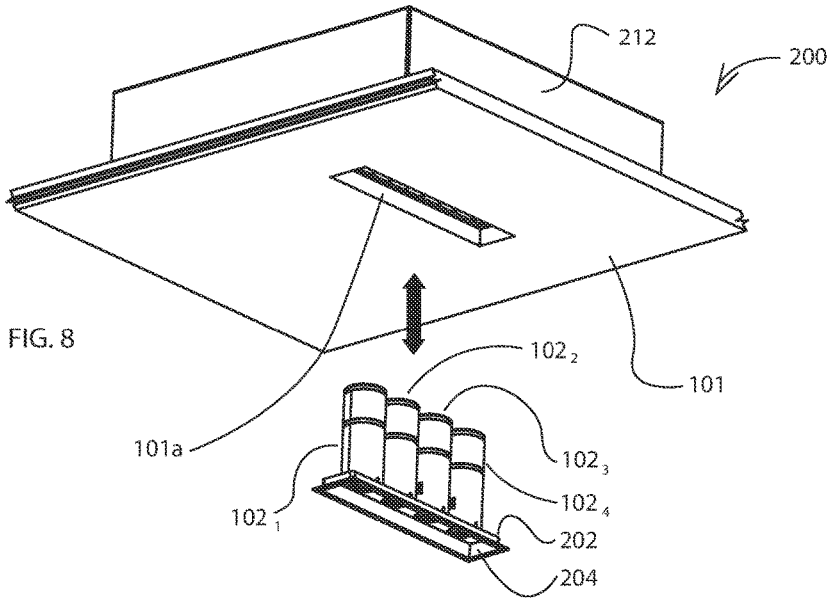
FIG. 8 is a perspective view of another example of a lighting device system, with lighting device modules shown external to the system.
Figure 10:
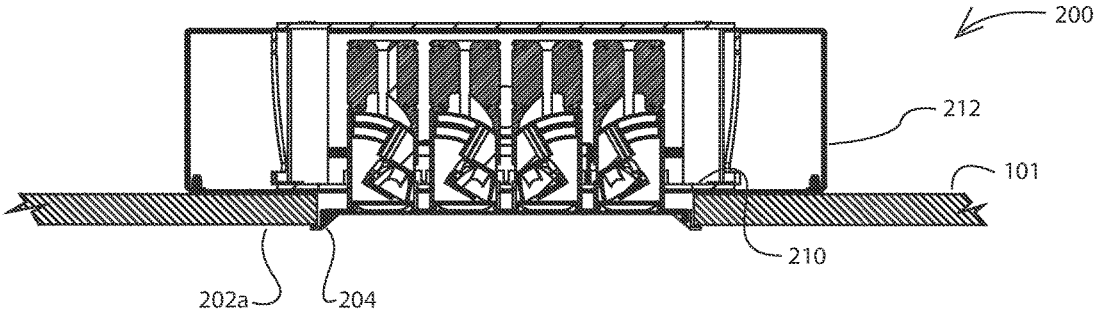
FIG. 10 is another cross-section view of the lighting device system of FIG. 8, with the lighting device modules in a partially inserted state.
Figure 9:
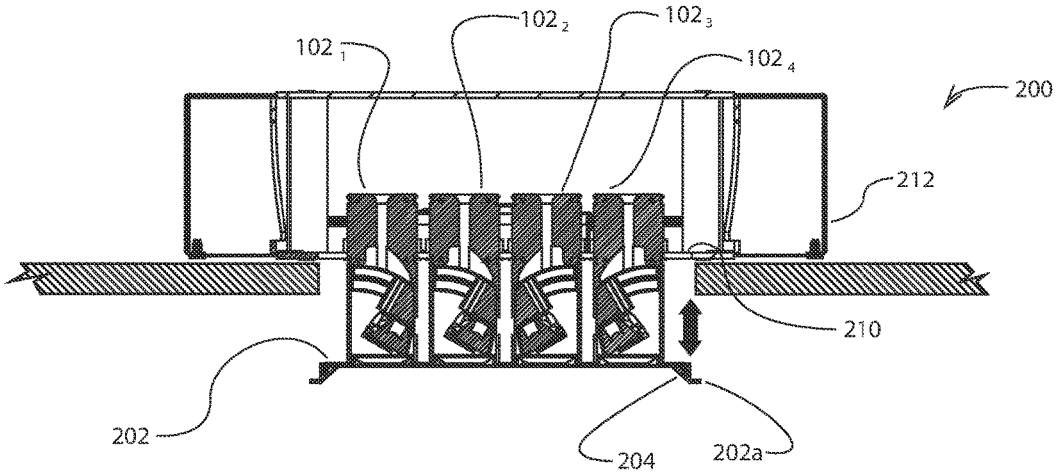
FIG. 9 is a cross-section view of the lighting device system of FIG. 8.
Figure 11:
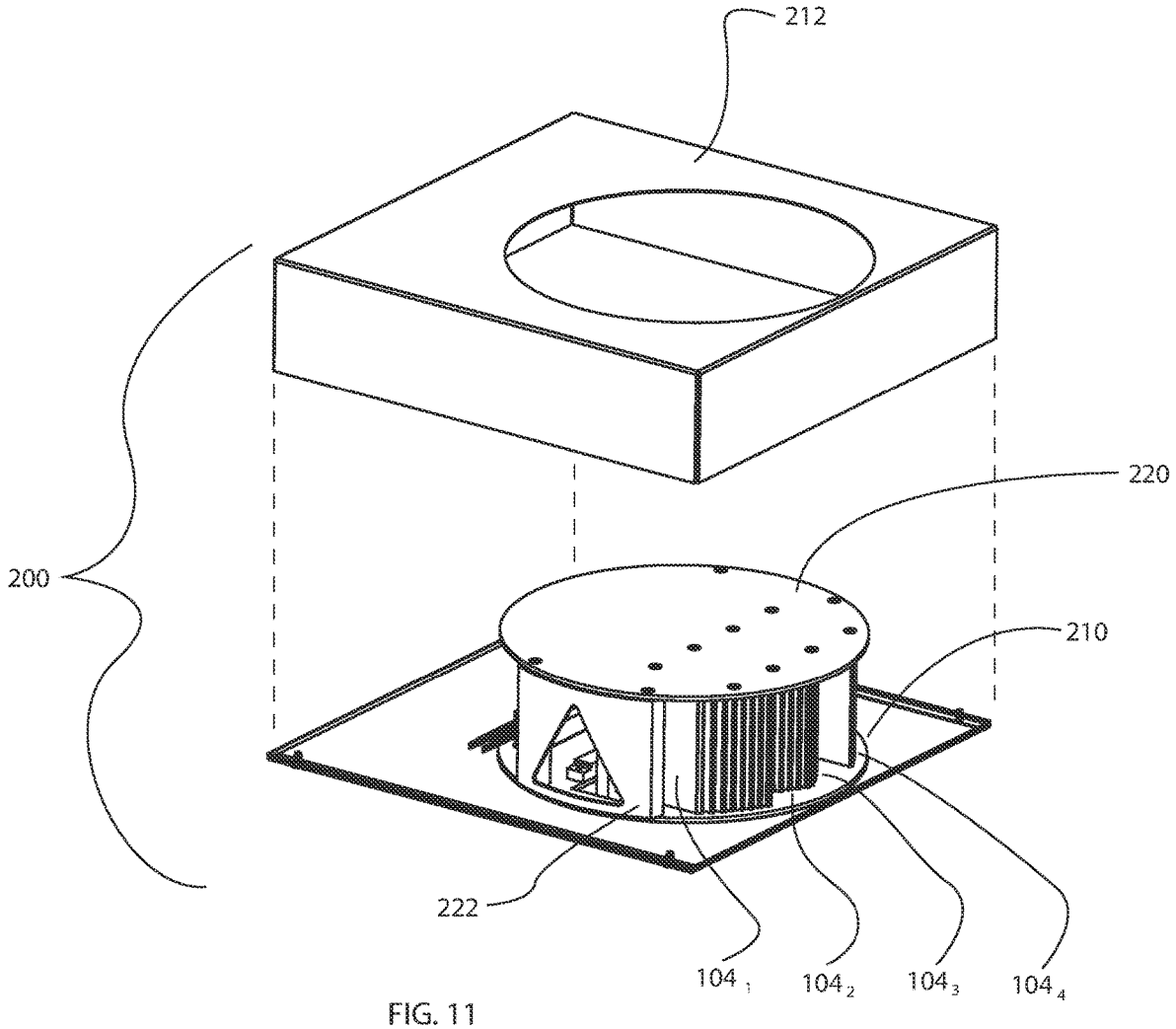
FIG. 11 is a partially exploded, perspective view of the lighting device system of FIG. 8, with the cover separated from the rest of the system.

The lighting device modules 102 in FIGS. 8-12 are configured to be passed at least partially through a single opening in the panel 101 (and, in some examples, through a single aligned opening in a base plate 210), for installation in the system 200, as shown in FIGS. 8-10. In other examples, more than one opening is provided in the panel 101 (and, in some examples, in the base plate 210), where one or more lighting device modules 102 are received in each respective opening.

In the example in FIGS. 8-12, the lighting device modules $\mathbf{102}_1$, $\mathbf{102}_2$, $\mathbf{102}_3$ and $\mathbf{102}_4$ are attached to a trim panel 202.

The trim panel 202 may include a single trim structure having multiple trim members similar to the trim member 195, but fixed or connected along a linear dimension. Accordingly, in certain examples, the trim panel 202 secures to each of the lighting device modules $\mathbf{102}_1$, $\mathbf{102}_2$, $\mathbf{102}_3$ and $\mathbf{102}_4$ in a manner similar to the manner in which the trim member 195 secures to the lighting device module 102 in the example of FIGS. 1-7. In other examples, the trim panel 202 may have other suitable configurations and may secure to the lighting device modules $\mathbf{102}_1$, $\mathbf{102}_2$, $\mathbf{102}_3$ and $\mathbf{102}_4$ with other suitable connection mechanisms as described herein with regard to the trim member 195. In certain other examples, a separate trim member (for example, but not limited to the trim member 195) may be connected to each separate lighting device module $\mathbf{102}_1$, $\mathbf{102}_2$, $\mathbf{102}_3$ and $\mathbf{102}_4$.

In the example in FIGS. 8-12, the trim panel 202 has a plurality of openings, each corresponding in size and shape to the outer peripheral dimension of each lighting device module $\mathbf{102}_1$, $\mathbf{102}_2$, $\mathbf{102}_3$ and $\mathbf{102}_4$. The light emitting end of each lighting device module $\mathbf{102}_1$, $\mathbf{102}_2$, $\mathbf{102}_3$ and $\mathbf{102}_4$ is secured to the trim panel 202, in alignment with an associated one of the openings in the trim panel 202, to direct light through that opening in the trim panel 202. In some examples, a single lens or other light affecting material 204 may be secured to the trim panel 202, over openings, such that light from the lighting device modules $\mathbf{102}_1$, $\mathbf{102}_2$, $\mathbf{102}_3$ and $\mathbf{102}_4$ passes through the openings in the trim panel 202 and through the lens 204 on the trim panel 202. In other examples, a separate lens or light affecting material may be placed over each separate opening in the trim panel 202.

The trim panel 202 may have a shape and a size corresponding to the shape and size of the opening in the panel 101. In the example in FIGS. 8-12, the trim panel 202 (and the opening 101*a* in the panel 101) have a generally rectangular shape. In other examples, the trim panel 202 (and the opening 101*a*) may have other suitable shapes including, but not limited to round, oval, polygonal or combinations thereof.

In some examples, the trim panel 202 has a shape and size that fits within (or partially within) the opening 101*a* in the panel 101. In particular examples, the trim panel 202 may have a lip 202*a* that remains external to the panel 101, when the trim panel is received (or partially received) in the opening 101*a* of the panel 101. In the example in FIGS. 8-12, the trim panel 202, with the multiple lighting device modules $\mathbf{102}_1$, $\mathbf{102}_2$, $\mathbf{102}_3$ and $\mathbf{102}_4$ secured thereto, is inserted into (or partially into) the opening 101*a*, with the lighting device modules $\mathbf{102}_1$, $\mathbf{102}_2$, $\mathbf{102}_3$ and $\mathbf{102}_4$ passing through (or partially through) the opening 101*a* (as shown in FIGS. 8 and 9). The lighting device system 200 may include any suitable connection mechanism to connect the trim panel 202 to the panel 101 or to the base plate 210, such as, but not limited to threaded fasteners, adhesives, welding, friction fitting, clamps or other fasteners. In other examples, the trim panel 202 is retained in the installed position by the friction force provided by one or more biasing devices (such as biasing device 106 described above) pressing the lighting device modules $\mathbf{102}_1$, $\mathbf{102}_2$, $\mathbf{102}_3$ and $\mathbf{102}_4$ against the contact surfaces 104*a* of the heat sink members 104.

When installed, the trim panel 202 (or the lip 202*a* of the trim panel 202) may fit flush with or abutted against the exposed surface (the downward-facing surface in FIGS. 8-10) of the panel 101, as shown in FIG. 10. In certain examples, the lip 202*a* of the trim panel 202 may be extended and may include a plurality of openings for receiving a plaster material, as describe above with regard to the lip of the trim member 195.

The lighting device system 200 in FIGS. 8-12 includes a base plate 210. The base plate 210 may correspond to the base plate 110 described above, but may be large enough to accommodate the plurality of lighting device modules $\mathbf{102}_1$, $\mathbf{102}_2$, $\mathbf{102}_3$ and $\mathbf{102}_4$ and associated heat sink members, biasing devices and driver electronics (e.g., corresponding to the heat sink member 104, the biasing device 106 and the driver electronics 108 discussed above). In other examples, the base plate 210 may be omitted, and the heat sink members, biasing devices and driver electronics may be mounted directly on the panel 101, as described above.

Figure 12:
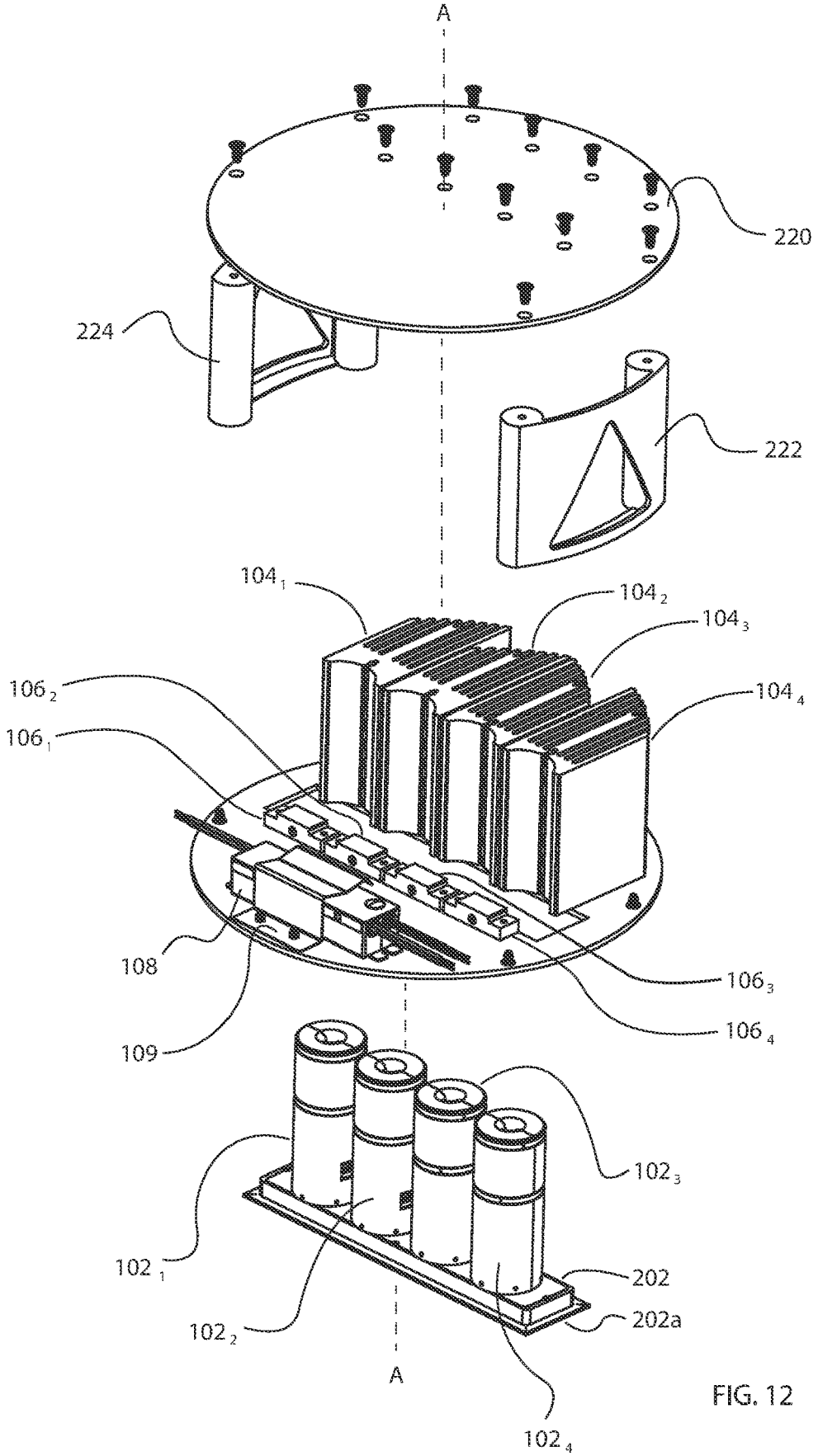
FIG. 12 is a partially exploded view of portions of the lighting device system of FIG. 8.

In the example in FIGS. 8-12, the base plate 210 has an opening 210*a* that aligns with the opening in the panel 101, and provides a passage through which the lighting device modules 102 may pass during installation. As shown in FIG. 12, four heat sink members $\mathbf{104}_1$, $\mathbf{104}_2$, $\mathbf{104}_3$ and $\mathbf{104}_4$ (each corresponding to the heat sink member 104 described herein) are mounted to a surface (the upward-facing surface in FIG. 12) of the base plate 210, such that a respective contact surface (corresponding to the contact surface 104*a*) of each heat sink member $\mathbf{104}_1$, $\mathbf{104}_2$, $\mathbf{104}_3$ and $\mathbf{104}_4$ is located adjacent and facing toward the opening 210*a*. In addition, four biasing devices $\mathbf{106}_1$, $\mathbf{106}_2$, $\mathbf{106}_3$ and $\mathbf{106}_4$ (each corresponding to the biasing device 106 described herein) are mounted to that surface of the base plate 210, on the opposite side of the opening 210*a* with respect to the contact surfaces 104*a* of the heat sink members $\mathbf{104}_1$, $\mathbf{104}_2$, $\mathbf{104}_3$ and $\mathbf{104}_4$. The biasing devices $\mathbf{106}_1$, $\mathbf{106}_2$, $\mathbf{106}_3$ and $\mathbf{106}_4$ are arranged to impart bias forces to press the lighting device modules $\mathbf{102}_1$, $\mathbf{102}_2$, $\mathbf{102}_3$ and $\mathbf{102}_4$ against the contact surface 104*a* of the heat sink members $\mathbf{104}_1$, $\mathbf{104}_2$, $\mathbf{104}_3$ and $\mathbf{104}_4$, respectively when the lighting device modules $\mathbf{102}_1$, $\mathbf{102}_2$, $\mathbf{102}_3$ and $\mathbf{102}_4$ are installed in the lighting device system 200.

When the lighting device modules $\mathbf{102}_1$, $\mathbf{102}_2$, $\mathbf{102}_3$ and $\mathbf{102}_4$ are inserted through the opening in the panel 101 (and, in some examples, in the base plate 210), each of the lighting device modules may be aligned with an associated, respective contact surface of a heat sink member $\mathbf{104}_1$, $\mathbf{104}_2$, $\mathbf{104}_3$ or $\mathbf{104}_4$, and with an associated biasing device $\mathbf{106}_1$, $\mathbf{106}_2$, $\mathbf{106}_3$ and $\mathbf{106}_4$. In that manner, each lighting device module $\mathbf{102}_1$, $\mathbf{102}_2$, $\mathbf{102}_3$ and $\mathbf{102}_4$ may be pressed against a contact surface 104*a* of a respective heat sink member $\mathbf{104}_1$, $\mathbf{104}_2$, $\mathbf{104}_3$ or $\mathbf{104}_4$, by the force of the associated biasing device $\mathbf{106}_1$, $\mathbf{106}_2$, $\mathbf{106}_3$ or $\mathbf{106}_4$. In particular examples, a separate respective heat sink member and a separate respective biasing device is provided for each separate, respective lighting device module $\mathbf{102}_1$, $\mathbf{102}_2$, $\mathbf{102}_3$ and $\mathbf{102}_4$. In other examples, a single heat sink member may include one or more contact surfaces for accommodating two or more of the lighting device modules. Similarly, a single biasing device may be configured to provide a biasing force on two or more of the lighting device modules.

The heat sink members $\mathbf{104}_1$, $\mathbf{104}_2$, $\mathbf{104}_3$ or $\mathbf{104}_4$ and the biasing devices $\mathbf{106}_1$, $\mathbf{106}_2$, $\mathbf{106}_3$ or $\mathbf{106}_4$ may be mounted to the panel 101 (or to the base plate 210) as described above for FIGS. 1-7, and may are arranged on opposite sides of the opening 101*a* to press a respective lighting device module against a respective one of the heat sink contact surfaces, when the lighting device modules $\mathbf{102}_1$, $\mathbf{102}_2$, $\mathbf{102}_3$ and $\mathbf{102}_4$ are received in the opening 101*a*. In addition, one or more driver electronics 108 (as described above) is mounted to the panel 101 (or to the base plate 210) via one or more brackets 109 (as described above)

Accordingly, the lighting device system 200 may be installed, electrically connected and operated in a manner similar to the lighting device system 100, but includes multiple lighting device modules $102_1$, $102_2$, $102_3$ and $102_4$. In certain examples, the lighting device system 200 may include a cover 212 corresponding to the cover 112 described above. In the example in FIGS. 8-12, the lighting device system 200 also includes a further cover 213 to which the cover 112 selectively connects, to enclose other components of the lighting device system 200. The further cover may be configured as a rigid plate-like member or other suitable configuration and may be made of any suitable rigid material including, but not limited to metal, plastic, ceramic, composite material, wood or combinations thereof. In particular examples, the cover 212 and the further cover 213 are made of a conductive metal that provides a thermal barrier and that connects to a ground conductor to provide an electrically grounded barrier. The cover 212 may connect to the further cover 213 with any suitable connection mechanism including, but not limited to threaded fasteners, adhesives, welding, thermal bonding or other fasteners, to form an enclosure or housing for other components of the lighting device system 200.

In certain examples, the base plate 210 may be mounted and supported for rotation between and relative to the cover 212 and the further cover 213. The base plate 210 may be mounted by any suitable mounting mechanism to the panel 101, or to the further cover 213. In certain examples, the mounting mechanism includes one or more of a guide for rotational motion, a rotational axel, a rotor or other support structure for supporting the base plate 210 for rotation relative to the cover 212 (or relative the cover 212 and a further cover 213). The rotational mounting mechanism allows the base plate 210 to be rotated (relative to the cover 212 and the further cover 213), to more easily align the opening 210*a* in the base plate 210 with the corresponding opening in the panel 101. More specifically, the housing covers 212 and 213 may be oriented in any suitable position, for example, to fit an available space in an attic, duct, plenum, inner wall or other space, while the base plate 210 may be rotated to align with the desired location of the opening in the panel 101.

In the example shown in FIGS. 8-12, the base plate 210 may have a round, plate-like shape. In addition, the further cover 213 may have a round opening having a diameter about the same or slightly larger than the diameter of the base plate 210, to allow the base plate 210 (with the heat sink members attached thereto), to be passed through the opening in the further cover 213, for installation, removal, inspection, or the like.

In certain examples, a second plate member 220 may be coupled to the base plate 210, by support brackets 222 and 224. Alternatively, or in addition, the second plate member 220 may be secured to the heat sink members $104_1$, $104_2$, $104_3$ or $104_4$ (e.g., the upward-facing surfaces of those heat sink members in FIG. 12). In particular examples, the second plate member 220 is made of a material having good (relatively high or fast rate) thermal conduction characteristics, such as, but not limited to a heat dissipating metal, plastic, ceramic or composite material, for receiving, spreading and dissipating heat from the heat sink members $104_1$, $104_2$, $104_3$ or $104_4$. The support brackets 222 and 224 may be made of any suitably rigid material for coupling the base plate 210 and the further plate 220 together. In certain examples, the support brackets 222 and 224 are arranged at least partially overlapping a portion of the further cover 213, to inhibit the base plate 210 from passing through the opening in the further cover 213.

In the illustrated example, both the base plate 210 and the further plate 220 have round, plate-like shapes and are coupled together, coaxially. In addition, the cover 212 has a round opening on an upper surface that is configured to align with the further plate 220, when the cover 212 is attached to the further cover 213. The round opening in the cover 212 can facilitate access to and assembly of the further plate 220, brackets 222 and 224, heat sink members $104_1$, $104_2$, $104_3$ and $104_4$, and other components with the base plate 210.

A volume space between the base plate 210 and the further plate 220 contains the heat sink members $104_1$, $104_2$, $104_3$ and $104_4$, the biasing device $106_1$, $106_2$, $106_3$ and $106_4$, and the driver electronics 108. That volume space also contains at least a portion of the lighting device modules $102_1$, $102_2$, $102_3$ and $102_4$, when the lighting device modules are installed in the system 200.

In various examples described herein, certain components are described as having a cone shape, cylindrical shape, rectangular shapes, round shapes or other shape including, but not limited to the module housing 102, the trim member 195, the trim panel 202, and the panels 210 and 220. However, in other examples, those components may have other suitable shapes including, but not limited to shapes having polygonal or other circular or non-circular cross-sections or combinations thereof. In some examples, those components may have an outer shape configured to provide an aesthetically pleasing, artistic, industrial or other impression.

The foregoing description of illustrative embodiments has been presented for purposes of illustration and of description. It is not intended to be exhaustive or limiting, and modifications and variations may be possible in light of the above teachings or may be acquired from practice of the disclosed embodiments. Various modifications and changes that come within the meaning and range of equivalency of the claims are intended to be within the scope of the invention. Thus, while certain embodiments of the present invention have been illustrated and described, it is understood by those of ordinary skill in the art that certain modifications and changes can be made to the described embodiments without departing from the spirit and scope of the present invention as defined by the following claims, and equivalents thereof.

What is claimed is:

1. A lighting device system comprising:

a plurality of lighting device modules, each lighting device module having a module housing configured to be inserted at least partially through an opening in a panel;

at least one heat sink member having a contact surface, the at least one heat sink member being located adjacent the opening in the panel; and a trim panel connected to a light output side of each lighting device module of the plurality of lighting device modules;

wherein the module housing of each lighting device module is held in contact with the contact surface of the at least one heat sink member when the module housing of each lighting device module is inserted at least partially through the opening in the panel in an installed state, and is configured to be selectively withdrawn from the contact surface of the heat sink member, through the opening in the panel.

2. The lighting device system of claim 1, further comprising at least one biasing device mounted adjacent the opening in the panel to apply a bias force on the at least one module housing, the bias force pressing the at least one module housing against the contact surface of the at least one heat sink member when the at least one module housing is inserted at least partially through the opening in the installed state.

3. The lighting device system of claim 1, further comprising:

a base plate made of a thermally conductive material and having an opening configured to be aligned with an opening in a panel at an installation site;

wherein each heat sink member is mounted on the base plate, adjacent the opening in the base plate;

wherein each module housing is configured to be inserted at least partially through the openings in the base plate and in the panel, and placed in contact with the contact surface of at least one of the heat sink members, when the opening in the base plate is aligned with the opening in the panel.

4. The lighting device system of claim 3, further comprising at least one biasing device mounted on the base plate adjacent the opening in the base plate, to apply a bias force on the module housing of each lighting device module, to press the module housing against the contact surface of one or more of the at least one heat sink member when the module housing is inserted at least partially through the opening in the base plate.

5. The lighting device system of claim 4, wherein each biasing device comprises a spring-biased plunger or ball that is arranged to press against an outer surface of the module housing and force the module housing in a direction toward the contact surface of one or more of the at least one heat sink member.

6. The lighting device system of claim 3, further comprising driver electronics mounted on the base plate and electrically connected to a light source of each lighting device module.

7. The lighting device system of claim 6, wherein the light source comprises at least one LED device and wherein the driver electronics comprises at least one LED driver.

8. A lighting device system comprising:

at least one lighting device module having a module housing configured to be inserted at least partially through an opening in a panel;

at least one heat sink member having a contact surface, the at least one heat sink member being located adjacent the opening in the panel;

a base plate made of a thermally conductive material and having an opening configured to be aligned with an opening in a panel at an installation site;

a cover member configured to cover the base plate and to be mounted in a fixed relation relative to the opening in the panel; and a rotary mount for supporting the base plate for rotation relative to the cover member, to allow the rotational orientation of the base plate relative to the opening in the panel to be adjusted;

wherein each heat sink member is mounted on the base plate, adjacent the opening in the base plate;

wherein each module housing is configured to be inserted at least partially through the openings in the base plate and in the panel, and placed in contact with the contact surface of at least one of the heat sink members, when the opening in the base plate is aligned with the opening in the panel; and wherein the module housing is held in contact with the contact surface of the at least one heat sink member when the module housing is inserted at least partially through the opening in the panel in an installed state, and is configured to be selectively withdrawn from the contact surface of the heat sink member, through the opening in the panel.

9. The lighting device system of claim 8, wherein the at least one lighting device module comprises a plurality of lighting device modules.

10. A lighting device system comprising:

a plurality of lighting device modules, each lighting device module having a module housing configured to be inserted at least partially through an opening in a panel; and at least one heat sink member having a contact surface, the at least one heat sink member being located adjacent the opening in the panel;

wherein the module housing of each lighting device module is held in contact with the contact surface of the at least one heat sink member when the module housing of each lighting device module is inserted at least partially through the opening in the panel in an installed state, and is configured to be selectively withdrawn from the contact surface of the heat sink member, through the opening in the panel;

wherein the at least one heat sink member comprises a plurality of heat sink members, and wherein the module housing of each lighting device module is held in contact with the contact surface of a respective one of the plurality of heat sink members when each module housing is inserted at least partially through the opening in the panel in an installed state, and is configured to be selectively withdrawn from the contact surface of the heat sink member, through the opening in the panel.

11. The lighting device system of claim 10, further comprising a trim panel connected to a light output side of each lighting device module of the plurality of lighting device modules.

12. The lighting device system of claim 11, further comprising at least one lens mounted on the trim panel, at a location through which light from the plurality of lighting device modules passes.

13. The lighting device system of claim 10, further comprising:

a base plate made of a thermally conductive material and having an opening configured to be aligned with an opening in a panel at an installation site;

wherein each heat sink member is mounted on the base plate, adjacent the opening in the base plate;

wherein each module housing is configured to be inserted at least partially through the openings in the base plate and in the panel, and placed in contact with the contact surface of at least one of the heat sink members, when the opening in the base plate is aligned with the opening in the panel.

14. The lighting device system of claim 13, further comprising a cover member configured to cover the base plate and to be mounted in a fixed relation relative to the opening in the panel; and a rotary mount for supporting the base plate for rotation relative to the cover member, to allow the rotational orientation of the base plate relative to the opening in the panel to be adjusted to align the opening in the base plate with the opening in the panel.

15. A lighting device system comprising:

at least one lighting device module, each having a module housing configured to be inserted at least partially through an opening in a panel;

at least one heat sink member, each having a contact surface and each being located adjacent the opening in the panel;

at least one biasing device located adjacent the opening in the panel, to apply a bias force on the module housing of each of the lighting device modules, to press each of the module housing against the contact surface of one or more of the heat sink members when the module housing is inserted at least partially through the opening in the panel;

a base plate made of a thermally conductive material and having an opening configured to be aligned with an opening in a panel at an installation site;

a cover member configured to cover the base plate and to be mounted in a fixed relation relative to the opening in the panel; and a rotary mount for supporting the base plate for rotation relative to the cover member, to allow the rotational orientation of the base plate relative to the opening in the panel to be adjusted to align the opening in the base plate with the opening in the panel;

wherein each heat sink member is mounted on the base plate, adjacent the opening in the base plate;

wherein each module housing is configured to be inserted at least partially through the openings in the base plate and in the panel, and placed in contact with the contact surface of at least one of the heat sink members, when the opening in the base plate is aligned with the opening in the panel; and wherein the module housing of each of the lighting device modules is pressed against and held in contact with the contact surfaces of one or more of the heat sink members when each of the module housings is inserted at least partially through the opening in the panel in an installed state, and is configured to be selectively withdrawn from the contact surfaces of the one or more heat sink members, through the opening in the panel.

16. A lighting device system of claim 15, wherein the at least one lighting device module comprises a plurality of lighting device modules, the at least one heat sink member comprises a plurality of heat sink members, and the at least one biasing device comprises a plurality of biasing devices.

17. A method of making a lighting device system comprising:

providing one or more lighting device modules, each having a module housing configured to be inserted at least partially through an opening in a panel;

mounting at least one heat sink members adjacent the opening in the panel, each heat sink member having a contact surface;

mounting at least one biasing device adjacent the opening in the panel, to apply a bias force on the module housing of each lighting device module, to press each of the module housing against the contact surface of the at least one heat sink member when the module housing is inserted at least partially through the opening in the panel;

arranging a base plate on the panel, the base plate being made of a thermally conductive material and having an opening configured to be aligned with the opening in the panel at an installation site;

inserting each module housing at least partially through the openings in the base plate and in the panel, and placing each module housing in contact with the contact surface of at least one of the heat sink members, when the opening in the base plate is aligned with the opening in the panel; and covering the base plate with a cover member mounted in a fixed relation relative to the opening in the panel; and supporting the base plate for rotation relative to the cover member, to allow the rotational orientation of the base plate relative to the opening in the panel to be adjusted to align the opening in the base plate with the opening in the panel;

wherein the module housing of each lighting device module is pressed against and held in contact with the contact surface of the at least one heat sink member when the module housing are inserted at least partially through the opening in the panel in an installed state, and is configured to be selectively withdrawn from the contact surface of the at least one heat sink member, through the opening in the panel.

18. The method of claim 17, wherein the at least one lighting device module comprises a plurality of lighting device modules, the at least one heat sink member comprises a plurality of heat sink members, and the at least one biasing device comprises a plurality of biasing devices.

* * * * *